US010190809B2

(12) United States Patent
Hosokawa

(10) Patent No.: US 10,190,809 B2
(45) Date of Patent: Jan. 29, 2019

(54) ACCUMULATOR

(71) Applicant: FUJIKOKI CORPORATION, Setagaya-ku, Tokyo (JP)

(72) Inventor: Kouji Hosokawa, Tokyo (JP)

(73) Assignee: FUJIKOKI CORPORATION, Tokyo (JP)

( * ) Notice: Subject to any disclaimer, the term of this patent is extended or adjusted under 35 U.S.C. 154(b) by 15 days.

(21) Appl. No.: 15/209,227

(22) Filed: Jul. 13, 2016

(65) Prior Publication Data

US 2017/0016657 A1 Jan. 19, 2017

(30) Foreign Application Priority Data

Jul. 14, 2015 (JP) ..... 2015-140327
Oct. 23, 2015 (JP) ..... 2015-209076
Nov. 26, 2015 (JP) ..... 2015-231052

(51) Int. Cl.
*F25B 43/00* (2006.01)
*F25B 13/00* (2006.01)

(52) U.S. Cl.
CPC ..... *F25B 43/006* (2013.01); *F25B 13/00* (2013.01); *F25B 43/003* (2013.01); *F25B 2400/23* (2013.01); *F25B 2500/01* (2013.01); *F25B 2500/12* (2013.01); *F25B 2500/26* (2013.01)

(58) Field of Classification Search
CPC .. F25B 43/003; F25B 2400/03; F25B 43/006; F25B 2500/01; F25B 13/00; F25B 2500/12; F25B 2500/26
USPC ..... 62/503
See application file for complete search history.

(56) References Cited

U.S. PATENT DOCUMENTS 4,276,756 A * 7/1981 Livesay ..... F25B 43/003 62/298
5,419,217 A * 5/1995 Umezawa ..... B21D 53/845 123/90.39

FOREIGN PATENT DOCUMENTS

| | | | | |
|---|---|---|---|---|
| CA | 2391375 A1 * | 6/2001 | ..... | B01D 53/0415 |
| EP | 1389722 A2 * | 2/2004 | ..... | F25B 43/006 |
| EP | 2 469 202 A2 | 6/2012 | | |
| JP | S61-60074 U | 4/1986 | | |
| JP | 11278045 A * | 10/1999 | ..... | B60H 1/00585 |
| JP | 2001-248923 A | 9/2001 | | |
| JP | 2004-263995 A | 9/2004 | | |
| JP | WO 2014038127 A1 * | 3/2014 | ..... | F25B 43/006 |
| JP | 2014-70869 A | 4/2014 | | |

OTHER PUBLICATIONS

Extended Search Report in corresponding European Application No. 16177870.9, dated Dec. 2, 2016, 3 pages.

* cited by examiner

*Primary Examiner* — Ana Vazquez
(74) *Attorney, Agent, or Firm* — Brinks Gilson & Lione

(57) ABSTRACT

Provided is an accumulator capable of effectively suppressing a bumping phenomenon and the following impact noise without making the structure of the accumulator complicated or increasing the cost and the size thereof. A protrusion serving as an origination of boiling is disposed at a part soaked with a liquid part including liquid-phase refrigerant and oil accumulated in the tank 10 of the accumulator 1. Especially the protrusion is disposed at least at a part of an outer periphery of the outer pipe 32 in a double-pipe structure, and an inner periphery and an upper face of a bottom of the tank 10.

17 Claims, 20 Drawing Sheets

V-V cross section

W-W cross section

X-X cross section

ACCUMULATOR

RELATED APPLICATIONS

The present application claims priority from Japanese patent applications JP 2015-140327 filed on Jul. 14, 2015, JP 2015-209076 filed on Oct. 23, 2015, and JP 2015-231052 filed on Nov. 26, 2015, the contents of which are hereby incorporated by reference into this application.

BACKGROUND OF THE INVENTION

1. Field of the Invention

The present invention relates to an accumulator (gas-liquid separator) used for a heat pump-type refrigerating cycle (hereinafter called a heat pump system), such as a car air-conditioner, a room air-conditioner, or a freezing machine.

2. Description of the Related Art

As illustrated in FIG. 20, a heat pump system 200 making up a car air-conditioner or the like typically includes a compressor 210, an outdoor heat exchanger 220, an indoor heat exchanger 230, an expansion valve 260, a four-way switching valve 240 and the like, as well as an accumulator 250.

In such a heat pump system 200, switching (channel switching) between cooling operation and heating operation is performed by the four-way switching valve 240. During cooling operation, refrigerant circulates in a cycle as shown in FIG. 20(A), and at this time, the outdoor heat exchanger 220 functions as a condenser, while the indoor heat exchanger 230 functions as an evaporator. During heating operation, refrigerant circulates in a cycle as shown in FIG. 20(B), and at this time, the outdoor heat exchanger 220 functions as an evaporator, while the indoor heat exchanger 230 functions as a condenser. For both types of the operation, refrigerant under low temperature and pressure and in a gas-liquid mixture state is introduced from the evaporator (the indoor heat exchanger 230 or the outdoor heat exchanger 220) to the accumulator 250 via the four-way switching valve 240.

For the accumulator 250, the structure as described in Patent Document 1, for example, is known, including a bottomed cylindrical tank having an upper opening thereof that is hermetically sealed with a lid member provided with an inflow port and an outflow port, a gas-liquid separating member having an outer diameter smaller than an inner diameter of the tank and having an umbrella-like or an inversed thin-bowl shape, an outflow pipe having a double-pipe structure, including an inner pipe having an upper end that is joined to the outflow port and hanging from there, and an outer pipe, a strainer disposed close to the bottom of (the outer pipe of) this outflow pipe to catch/remove foreign matters contained in liquid-phase refrigerant and oil (refrigerant oil) mixed therein, and the like.

Refrigerant introduced into this accumulator 250 collides with the gas-liquid separating member to be diffused radially and to be separated into liquid-phase refrigerant and gas-phase refrigerant. The liquid-phase refrigerant (including oil) flows down along the inner periphery of the tank and is accumulated at a lower part of the tank, and the gas-phase refrigerant descends through the space defined between the inner pipe and the outer pipe in the outflow pipe (gas-phase refrigerant descending channel) and then ascends through the space within the inner pipe to be sucked from the suction side of the compressor 210 for circulation.

Oil accumulated at the lower part of the tank together with the liquid-phase refrigerant moves toward the tank bottom because of a difference in specific weight, properties or the like from the liquid-phase refrigerant, is sucked by the gas-phase refrigerant that is sucked from the suction side of the compressor via the outflow pipe, and then passes through (a net filter of) the strainer→an oil returning port formed at the bottom of the outflow pipe (outer pipe)→the space within the inner pipe of the outflow pipe and is returned to the suction side of the compressor together with the gas-phase refrigerant for circulation (see Patent Documents 2, 3 as well).

Meanwhile, when the operation of the system (compressor) is stopped, liquid-phase refrigerant including oil is accumulated at the lower part of the tank of the accumulator. In this case, when the oil used is not compatible with the refrigerant and has specific weight smaller than that of the refrigerant, they are separated into two layers due to a difference in specific weight and viscosity between the liquid-phase refrigerant and the oil, i.e., the oil layer is formed above and the liquid-phase refrigerant layer is formed below.

In such a two-layered separation state, when the system (compressor) is started, then the pressure in the tank drops rapidly, and so the liquid-phase refrigerant boils suddenly and vigorously (hereinafter called bumping), which causes loud impact noise unfortunately.

Presumably such a bumping phenomenon and the following impact noise are generated because of the following reason. Such a bumping phenomenon can be suppressed till some point due to the presence of the oil layer serving as the lid of the refrigerant layer (no bumping phenomenon occurs at the oil layer) even when the pressure in the tank (suction side of the compressor) drops during the starting of the compressor. However, if a difference in pressure between the above of the oil layer (the gas-phase refrigerant) and the below (the liquid-phase refrigerant) becomes a predetermined value or more, the liquid-phase refrigerant boils at once and explosively, and therefore these phenomena will occur (see Patent Document 2 also, describing a bumping phenomenon in the compressor).

Alternatively, when oil and liquid-phase refrigerant are not in a two-layered separation state as stated above during stopping of the compressor, i.e., when the oil and the liquid-phase refrigerant are in a mixture state during stopping of the compressor as well, or also in the case where the oil used is not compatible with the refrigerant and has specific weight larger than that of the refrigerant, and the liquid-phase refrigerant layer is formed above and the oil layer is formed below, the aforementioned bumping phenomenon where the liquid-phase refrigerant boils at once and explosively and the following impact noise may occur depending on the conditions, such as types of the refrigerant and the oil, and their properties.

As a measure to suppress such a bumping phenomenon and the following impact noise, the above-mentioned Patent Document 2 proposes the technique of providing an agitation blade at the rotating shaft (crankshaft) of the compressor including a reciprocating engine as a driving source, and rotating the agitation blade for agitation of the oil-layer part during starting of the compressor so as to discharge the liquid-phase refrigerant to the above of the oil.

Patent Document 3 proposes the technique of, in order to mix the oil and the liquid-phase refrigerant in a two-layered separation state reliably in (the tank) of the accumulator as a main purpose, blowing a part of the gas-phase refrigerant discharged from the compressor into the liquid-phase refrigerant for agitation from the bottom of the tank via a bypass channel having an open/close valve.

3. Related Patent Documents

Patent Document 1: JP 2014-70869 A

Patent Document 2: JP 2001-248923 A

Patent Document 3: JP 2004-263995 A

SUMMARY OF THE INVENTION

As stated above, a liquid part of the oil and the liquid-phase refrigerant in the tank is agitated during the starting of the compressor, whereby a bumping phenomenon and the following impact noise can be suppressed, which can be confirmed by the present inventors or the like as well. According to the aforementioned conventionally proposed techniques, however, means for agitating, including an agitating blade, a driving source to rotate the blade, a bypass channel having an open/close valve and the like is required separately, which may lead to the problems that the structure of the accumulator (and a heat pump system including it) becomes complicated, or the cost and the size thereof increase.

In view of these circumstances, the present invention aims to provide an accumulator capable of effectively suppressing a bumping phenomenon and the following impact noise during the starting of the compressor without making the structure of the accumulator complicated or increasing the cost and the size thereof.

In order to fulfill the aim, an accumulator according to the present invention basically includes: a tank having an inflow port and an outflow port; and an outflow pipe joined to the outflow port and disposed in the tank, wherein a protrusion serving as an origination of boiling is disposed at a part soaked with a liquid part including liquid-phase refrigerant and oil accumulated in the tank of the accumulator.

Preferably the outflow pipe has a double-pipe structure including an inner pipe joined to the outflow port and hanging inside of the tank, and an outer pipe disposed outside of the inner pipe, and the protrusion is disposed at least at a part of an outer periphery of the outer pipe, and an inner periphery and an upper face of a bottom of the tank.

In a preferable form, the protrusion is disposed at a position above the bottom of the tank by a predetermined height and/or at a position below from the upper end of the outer pipe by a predetermined height.

In another preferable form, the protrusion is disposed at least at a height area between a lower-limit liquid surface height position where abnormal sound is generated because of bumping of the liquid part and a highest liquid surface height position of the liquid part.

Preferably the protrusion protrudes spirally or along the vertical direction on the outer periphery of the outer pipe.

Preferably the protrusion protrudes spirally or along the vertical direction on the inner periphery of the tank.

Preferably the protrusion protrudes annularly, spirally or radially on the upper face of the bottom of the tank.

Preferably the protrusion is formed by pressing or cutting.

Preferably the protrusion is formed by knurling or threading.

Preferably the protrusion is formed concurrently with forming of a component of the outer pipe or of the tank.

In another preferable form, a cloth-like member or a foam material is wound around or externally inserted to the outer pipe.

In a more preferable form, the cloth-like member or the foam material is wound around or externally inserted to at least a height area between a lower-limit liquid surface height position where abnormal sound is generated because of bumping of the liquid part and a highest liquid surface height position of the liquid part.

In another preferable form, the cloth-like member is provided with a desiccant storage part to store desiccant to absorb and remove water in refrigerant.

Preferably the desiccant storage part is disposed vertically and externally to the outer pipe.

Preferably the desiccant storage part is disposed externally to the outer pipe at a position closer to the inflow port.

In another preferable form, the cloth-like member or the foam material includes a long and thin material that is wound around or externally inserted spirally to the outer pipe so that there is a gap between the end faces of the long and thin material, the end faces abut, or the end faces are overlapped.

In another preferable form, the cloth-like member or the foam material includes a plurality of pieces of material that is wound around or externally inserted to the outer pipe so that there is a gap between the end faces of the plurality of pieces, the end faces abut, or the end faces are overlapped.

In another preferable form, the cloth-like member or the foam material has a slit.

Preferably the slit is formed horizontally, vertically, diagonally to the vertical direction in a lateral view, or spirally.

The accumulator according to the present invention is configured so that protrusions serving as an origination of boiling (generation of air bubbles) are provided at a part soaked with a liquid part (liquid-phase refrigerant and oil) accumulated in the tank of the accumulator, and the protrusions serve an origination (trigger) for boiling of the liquid-phase refrigerant for vaporization during the starting of the compressor, which leads to the state where the liquid-phase refrigerant boils gradually (boiling lighter than bumping) when the pressure drops in the tank. That is, by the protrusions, boiling lighter in degree than the bumping is promoted before the pressure reaches a predetermined value where a bumping phenomenon occurs, followed by the impact noise, and therefore boiling of the liquid-phase refrigerant proceeds gently, so that a bumping phenomenon during the starting of the compressor and the following impact noise can be effectively suppressed.

In this case, just the outflow pipe and the tank provided with the protrusions that are formed by pressing, cutting, knurling, threading, or concurrently forming with the forming of another component at low cost and simply have to be prepared basically, and therefore the configuration of the accumulator can be simplified as compared with the conventional configuration including means for agitating, such as an agitating blade, a driving source to rotate the blade, a bypass channel having an open/close valve, and the cost, the size and the like of the accumulator can be reduced.

In the accumulator of the present invention, the cloth-like member such as felt or the foam material (hereinafter called a cloth-like member or the like) wound around or externally inserted to the outer pipe of the outflow pipe serves as boiling stone. That is, the cloth-like member or the like (gas therein) can be an origination (trigger) for boiling of the liquid-phase refrigerant for vaporization during starting of the compressor, which leads to the state where air bubbles come out gradually, i.e., the liquid-phase refrigerant is gradually vaporized. Therefore boiling of the liquid-phase refrigerant proceeds gently and as a result a bumping phenomenon in which the liquid-phase refrigerant boils at once and explosively, and impact noise generated accordingly can be effectively suppressed.

In this case, the accumulator of the present invention includes a simple configuration added, like the cloth-like member or the like that is wound around or externally inserted to the outer pipe in the conventional accumulator, and therefore this has excellent cost-effectiveness without making the structure of the accumulator complicated or increasing the cost and the size thereof as in the conventional techniques as stated above.

Since the cloth-like member such as felt has air permeability and water permeability, the desiccant storage part to store desiccant therein to absorb and remove water in the refrigerant is disposed at the cloth-like member, such as felt, that is wound around or externally inserted to the outer pipe, whereby the desiccant storage part serves as a bag. Therefore there is no need to prepare a bag to store desiccant or its fixing means (e.g., banding band) separately, and so the cost-effectiveness can be improved more.

Further, the cloth-like member or the like may be wound around the outer pipe spirally, a plurality of pieces of material making up the cloth-like member or the like may be prepared, and they may be wound around so that there is a gap between the end faces of the plurality of pieces, the end faces abut, or the end faces are overlapped, or the cloth-like member or the like may have a slit. In this case, bumping can be prevented and the following impact noise can be suppressed more effectively.

DETAILED DESCRIPTION OF THE PREFERRED EMBODIMENTS

The following describes embodiments of the present invention, with reference to the drawings.

Embodiment 1

Figure 1:
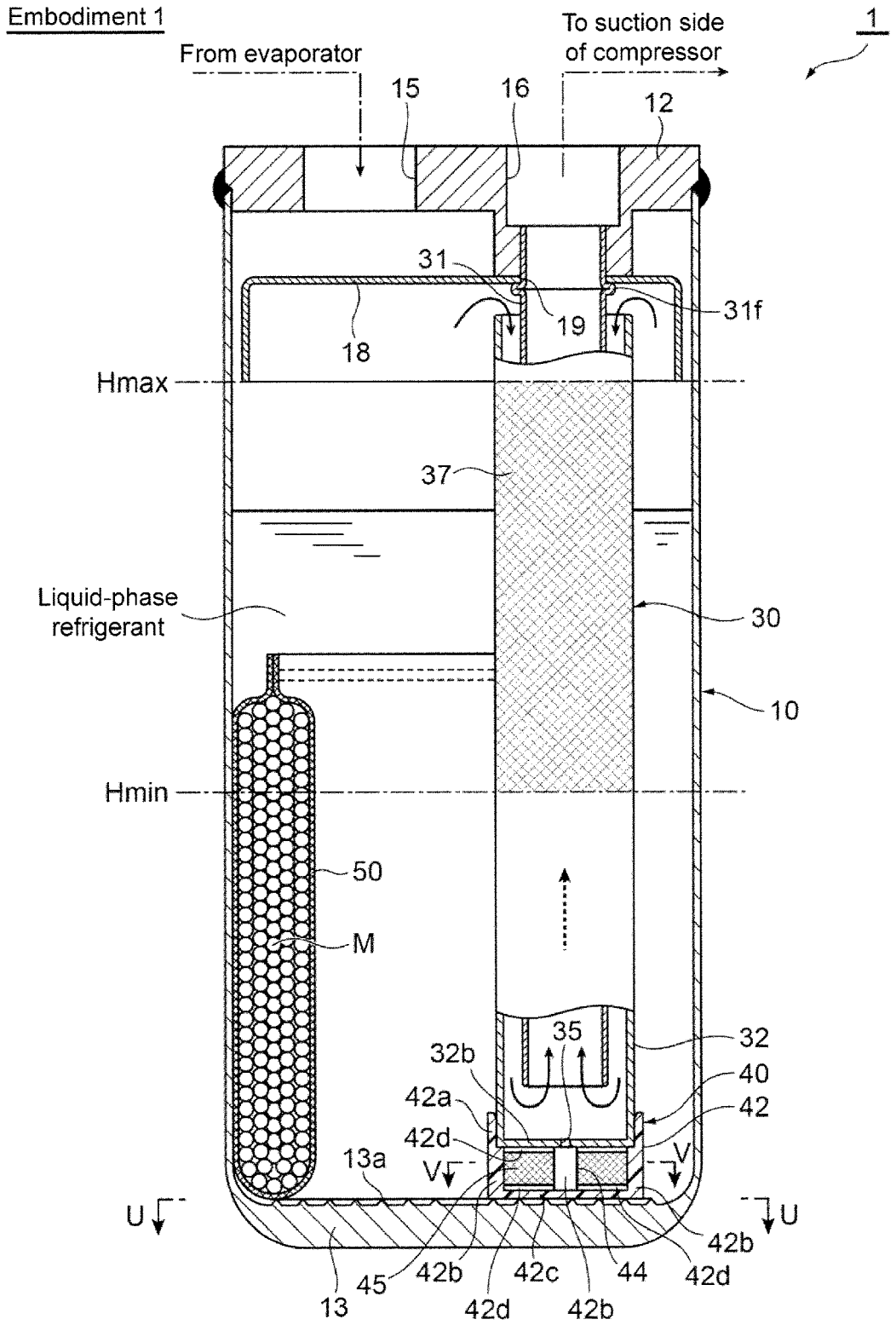
FIG. 1 is a partially cutaway front view showing Embodiment 1 of an accumulator according to the present invention.
Figure 2:
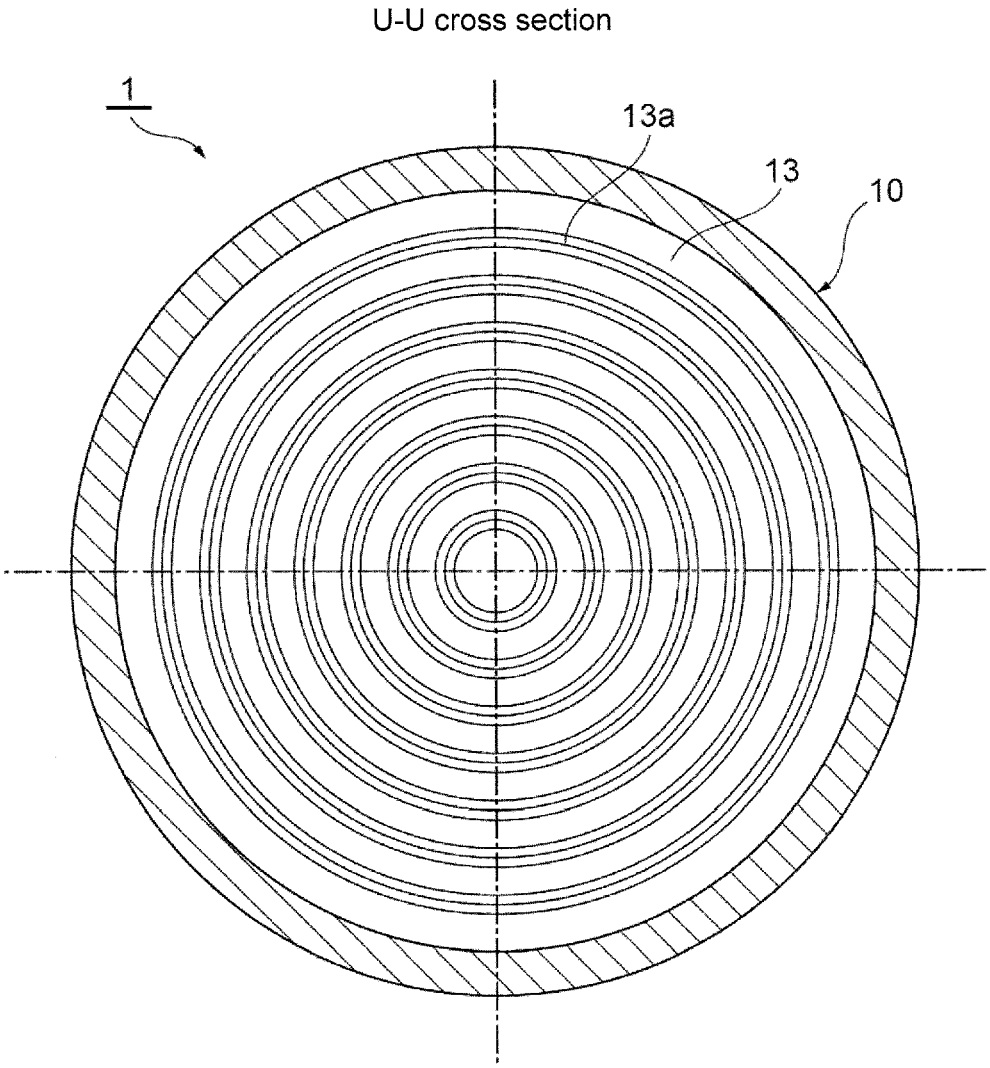
FIG. 2 is an enlarged cross-sectional view taken along the arrow U-U of FIG. 1.

FIG. 1 is a partially cutaway front view showing Embodiment 1 of an accumulator according to the present invention, and FIG. 2 is an enlarged cross-sectional view taken along the arrow U-U of FIG. 1.

Figure 20B:
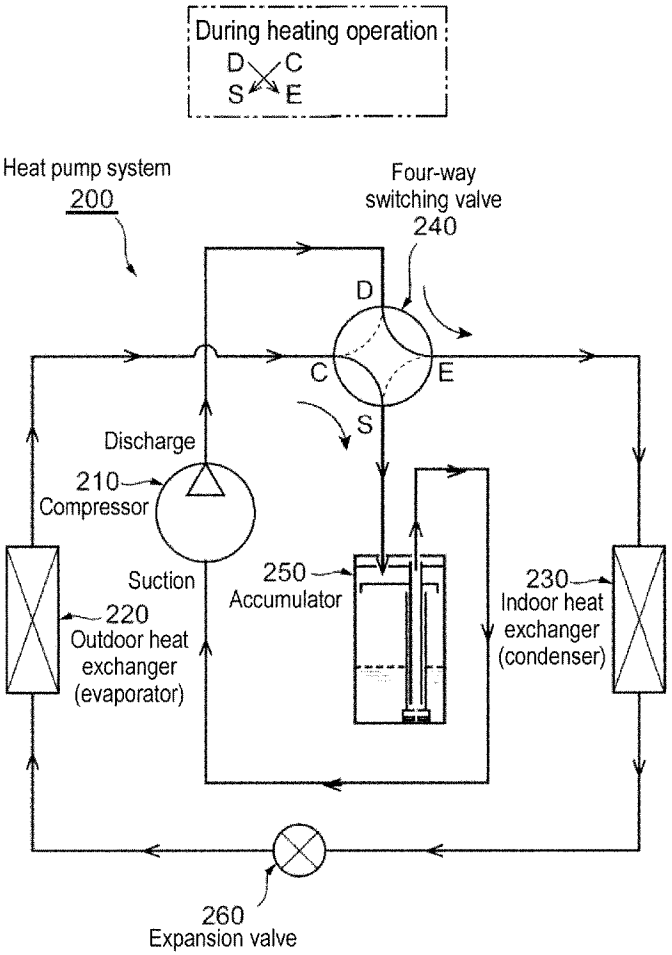
FIG. 20 shows one example of a heat pump system, where FIG. 20A schematically shows the configuration showing the flow (cycle) of refrigerant during cooling operation, and FIG. 20B schematically shows the configuration showing the flow (cycle) of refrigerant during heating operation.
Figure 20A:
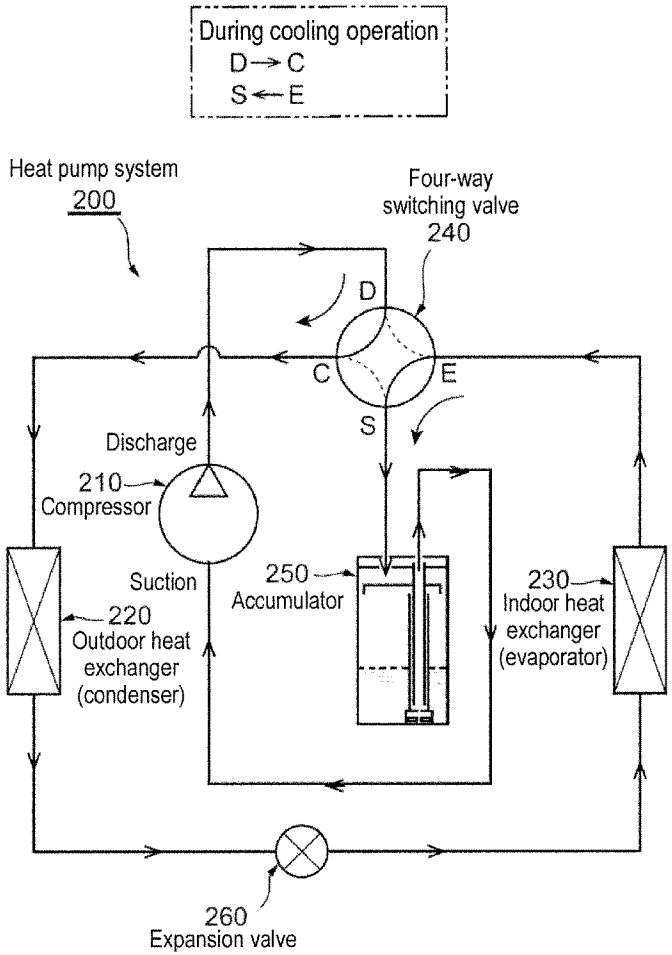

An accumulator 1 of Embodiment 1 in the drawing can be used as the accumulator 250 in the heat pump system 200 making up a car air-conditioner for electric vehicles, for example, as shown in FIG. 20 as stated above, and includes a bottomed cylindrical tank 10 made of metal, such as stainless steel or aluminum alloy, where the upper opening of this tank 10 is hermetically sealed with a lid member 12 made of the same metal. The tank 10 has a bottom 13 where a plurality of annular protrusions 13*a* serving as an origination of boiling (generation of air bubbles) are formed concentrically on the upper face (the inner face) by pressing or cutting, for example. Note here that the accumulator 1 of the present embodiment is installed vertically as illustrated, for example, i.e., the lid member 12 is located above (top) and the bottom 13 of the tank 10 is located below (bottom).

The lid member 12 has an inflow port 15 and a stepped outflow port 16 disposed side by side, a gas-liquid separating member 18 is disposed below the lid member 12, the gas-liquid separating member 18 having an outer diameter smaller than an inner diameter of the tank 10 and having an umbrella-like or an inversed thin-bowl shape, and an upper end of an outflow pipe 30 is jointed to the lower part of the outflow port 16.

The outflow pipe 30 has a double-pipe structure, including a metal inner pipe 31, the upper end of which is joined to the lower part of the outflow port 16 by swaging or press-fitting, for example, hanging inside of the tank 10 and a bottomed outer pipe 32 made of synthetic resin that is disposed around the inner pipe 31. As described below, the outer pipe 32 is provided with a knurling part 37 on the outer periphery, in which a plurality of protrusions serving as an origination of boiling are formed by knurling.

Preferably at least one of the inner pipe 31 and the outer pipe 32 is provided with ribs to keep a predetermined gap therebetween.

The inner pipe 31, the outer pipe 32 and the ribs may be integrally formed by extrusion forming using an aluminum material or the like. That is, the aforementioned double-pipe structure may be an integrally-formed product made of an aluminum extruded material.

The lower end of the outer pipe 32 is internally fitted for fixing to an internally stepped upper part 42*a* of a case 42 of a strainer 40 described later by press fitting or the like. The lower end of the inner pipe 31 is located slightly above a bottom 32*b* of the outer pipe 32, and the upper end of the outer pipe 32 is located slightly below the lid member 12. At a center of the bottom 32*b* of the outer pipe 32, an oil returning hole 35 is formed. The oil returning hole 35 has a diameter of about 1 mm, for example.

The inner pipe 31 is provided with a flange 31*f* at a part close to the upper end thereof, which is prepared by compressing and bending by bulge forming, for example. When the gas-liquid separating member 18 and the inner pipe 31 are assembled to the lid member 12, the upper end of the inner pipe 31 is allowed to pass through a hole 19 formed at the gas-liquid separating member 18, while press-fitting or performing expansion of the inner pipe for fixing to the outflow port 16 from the below. Thereby, the gas-liquid separating member 18 can be held and fixed so as to be sandwiched between the flange 31*f* and the lower-end face of the lid member 12.

Figure 3:
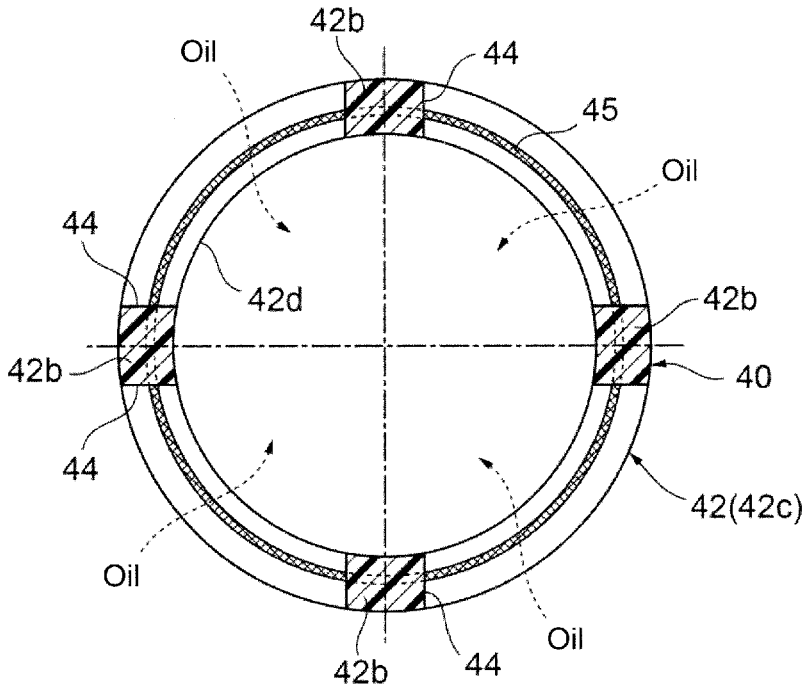
FIG. 3 is an enlarged cross-sectional view taken along the arrow V-V of FIG. 1.

The strainer 40 is placed on the bottom 13 of the tank 10 where the annular protrusions 13*a* are formed as stated above and is fixed there, and as understood from FIG. 3, the strainer 40 includes the bottomed cylindrical case 42 made of synthetic resin and a cylindrical net filter 45 that is integral with the case 42 by insert molding. The net filter 45 may be prepared using metallic mesh or a mesh material made of synthetic resin, for example.

The case 42 of the strainer 40 includes: the internally stepped upper part 42*a* to which the lower end of the outer pipe 32 is internally fitted for fixing; a bottom-plate part 42*c*; four pillar parts 42*b* that are vertically disposed at equal angular intervals at the outer periphery of this bottom-plate part 42*c*; and annular belt-shaped mesh-end embedded parts 42*d*, 42*d* having predetermined thickness and belt width and including the upper ends and the lower ends of these pillar parts 42*b*. The upper and lower ends of the net filter 45 are integrated with these upper and lower mesh-end embedded parts 42*d*, 42*d* for sealing during insert molding, and a part of the net filter 45 corresponding to the pillar parts 42*b* also is integrated with the pillar parts 42*b* for sealing during insert molding. In other words, the four pillar parts 42*b* and the upper and lower mesh-end embedded parts 42*d*, 42*d* define four windows 44 having a rectangular shape in side view, and the net filter 45 is stretched over each of these windows 44. The four pillar parts 42*b* have an inclination for removal from a mold, but the four pillar parts 42*b* and the upper and lower mesh-end embedded parts 42*d*, 42*d* have a substantially same width in the radial direction.

In the tank 10, a bag 50 containing desiccant M having a height that is about a half of the height of the tank 10 is placed on the bottom 13 so as to be along the inner periphery of the tank 10 so as to absorb and remove water in refrigerant. This bag 50 is made of a cloth-like member such as felt having air permeability and water permeability as well as a required shape-keeping property, and the bag 50 is substantially full of grains of the desiccant M.

In the thus configured accumulator 1, similarly to the conventional ones, refrigerant under low temperature and pressure and in a gas-liquid mixture state from the evaporator is introduced into the tank 10 through the inflow port 15, and the introduced refrigerant collides with the gas-liquid separating member 18 to be diffused radially and to be separated into liquid-phase refrigerant and gas-phase refrigerant. The liquid-phase refrigerant (including oil) flows down along the inner periphery of the tank 10 and is accumulated at a lower space of the tank 10, and the gas-phase refrigerant passes through the space (gas-phase refrigerant descending channel) defined between the inner pipe 31 and the outer pipe 32 in the outflow pipe 30→internal space of the inner pipe 31 and then is sucked from the suction side of the compressor 210 for circulation.

Oil accumulated at the lower space of the tank 10 together with the liquid-phase refrigerant moves toward the bottom 13 of the tank 10 because of a difference in specific weight, properties or the like from the liquid-phase refrigerant, is sucked by the gas-phase refrigerant that is sucked from the suction side of the compressor via the outflow pipe 30, and then passes through the net filter 45 of the strainer 40→the oil returning hole 35→the internal space of the inner pipe 31 and is returned to the suction side of the compressor together with the gas-phase refrigerant for circulation. When it passes through the net filter 45, foreign matters such as sludge are caught there, and the foreign matters are removed from the circulating refrigerant (including oil).

In addition to the configuration as stated above, the accumulator 1 of the present embodiment includes the knurling part 37 on the outer periphery of the outer pipe 32, in which a plurality of protrusions serving as an origination of boiling are formed by knurling, and on the bottom 13 of the tank 10, the plurality of (seven in the drawing) annular protrusions 13*a* serving as an origination of boiling are formed concentrically on the upper face (the inner face) by pressing, cutting or the like.

In this case, the knurling part 37 is provided over a height area between the lower-limit liquid surface height position Hmin where abnormal sound (impact noise) is generated because of bumping of a liquid part (liquid-phase refrigerant and oil) accumulated in the tank 10 during stopping of the compressor 210 and the highest liquid surface height position Hmax of the liquid part. These lower-limit liquid surface height position Hmin and highest liquid surface height position Hmax can be predetermined for the system at a position above the bottom 13 of the tank 10 by a predetermined height or at a position below from the upper end of the outer pipe 32 by a predetermined height.

Herein the protrusions at the knurling part 37 of the outer pipe 32 or the protrusions 13*a* on the upper face of the bottom 13 of the tank 10 have sharply formed tips so as to promote boiling.

As stated above, the accumulator 1 of the present embodiment is configured so that the protrusions (including the protrusions at the knurling part 37 on the outer pipe 32 and the protrusions 13*a* on the upper face of the bottom 13 of the tank 10) serving as an origination of boiling (generation of air bubbles) are provided at a part soaked with a liquid part (liquid-phase refrigerant and oil) accumulated in the tank 10 of the accumulator 1, and the protrusions serve an origination (trigger) for boiling of the liquid-phase refrigerant for vaporization during the starting of the compressor 210 and prior to the occurrence of the bumping phenomenon and the following impact noise, which leads to the state where the liquid-phase refrigerant boils gradually (boiling lighter than bumping) when the pressure drops in the tank 10. That is, by the protrusions, boiling lighter in degree than the bumping is promoted before the pressure reaches a predetermined value where a bumping phenomenon occurs, followed by the impact noise, and therefore boiling of the liquid-phase refrigerant proceeds gently, so that a bumping phenomenon during the starting of the compressor 210 and the following impact noise can be effectively suppressed.

In this case, just (the outer pipe 32 of) the outflow pipe 30 and the tank 10 provided with the protrusions that are formed by pressing, cutting or knurling at low cost and simply have to be prepared, and therefore the configuration of the accumulator can be simplified as compared with the conventional configuration including means for agitating, such as an agitating blade, a driving source to rotate the blade, a bypass channel having an open/close valve, and the cost, the size and the like of the accumulator can be reduced.

In order to suppress a bumping phenomenon and the following impact noise, the protrusions have to be provided above the lower-limit liquid surface height position Hmin basically. In this respect, the protrusions 13*a* are provided at the bottom 13 of the tank 10 of the accumulator 1 of the present embodiment, and therefore even when the liquid surface height of the liquid part is lower than the lower-limit liquid surface height position Hmin and abnormal sound that is not larger than the impact noise resulting from the bumping phenomenon occurs, these protrusions 13*a* can make such abnormal sound smaller, and the protrusions 13*a* lead to another advantageous effect of suppressing the slipping of the strainer 40 that is placed on the bottom 13 of the tank 10.

Figure 4:
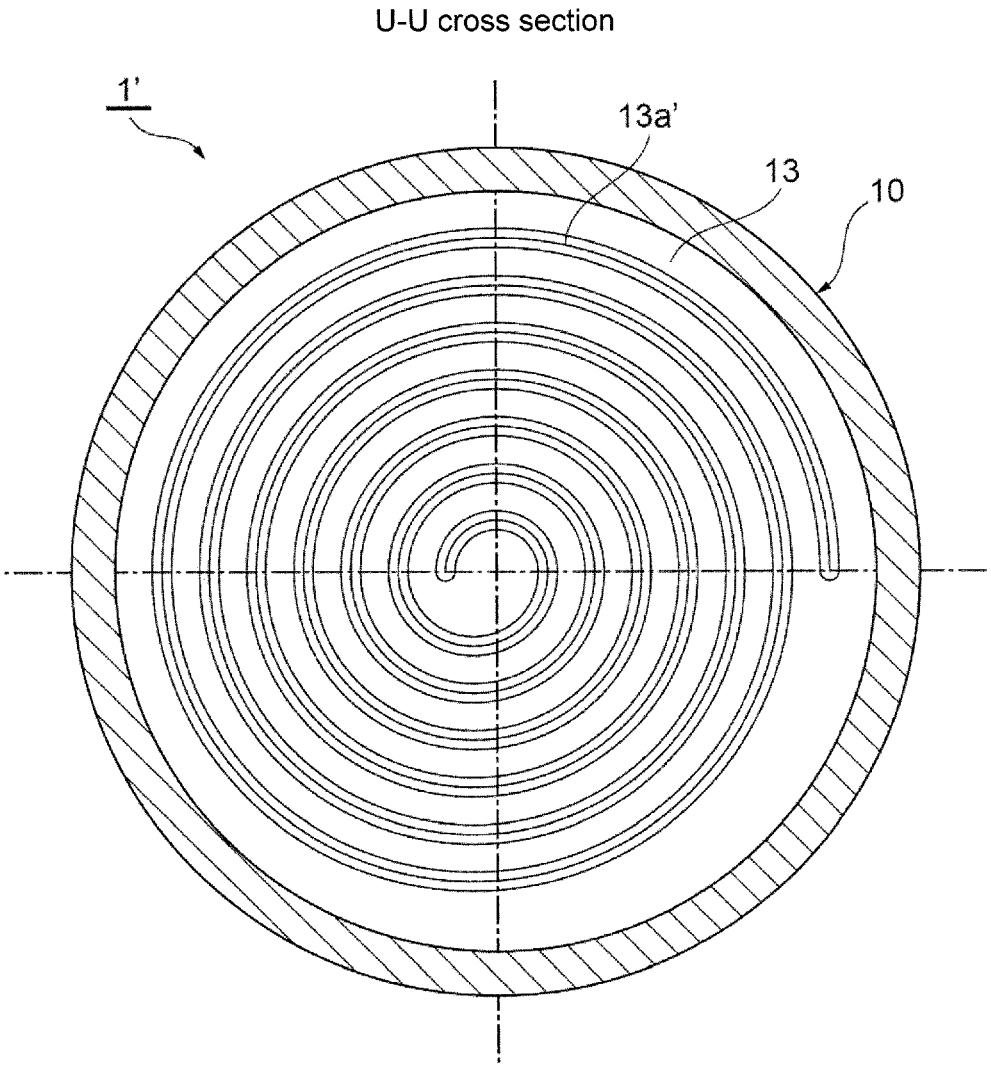
FIG. 4 is an enlarged cross-sectional view showing a tank bottom in another example of the accumulator shown in FIG. 1.
Figure 5:
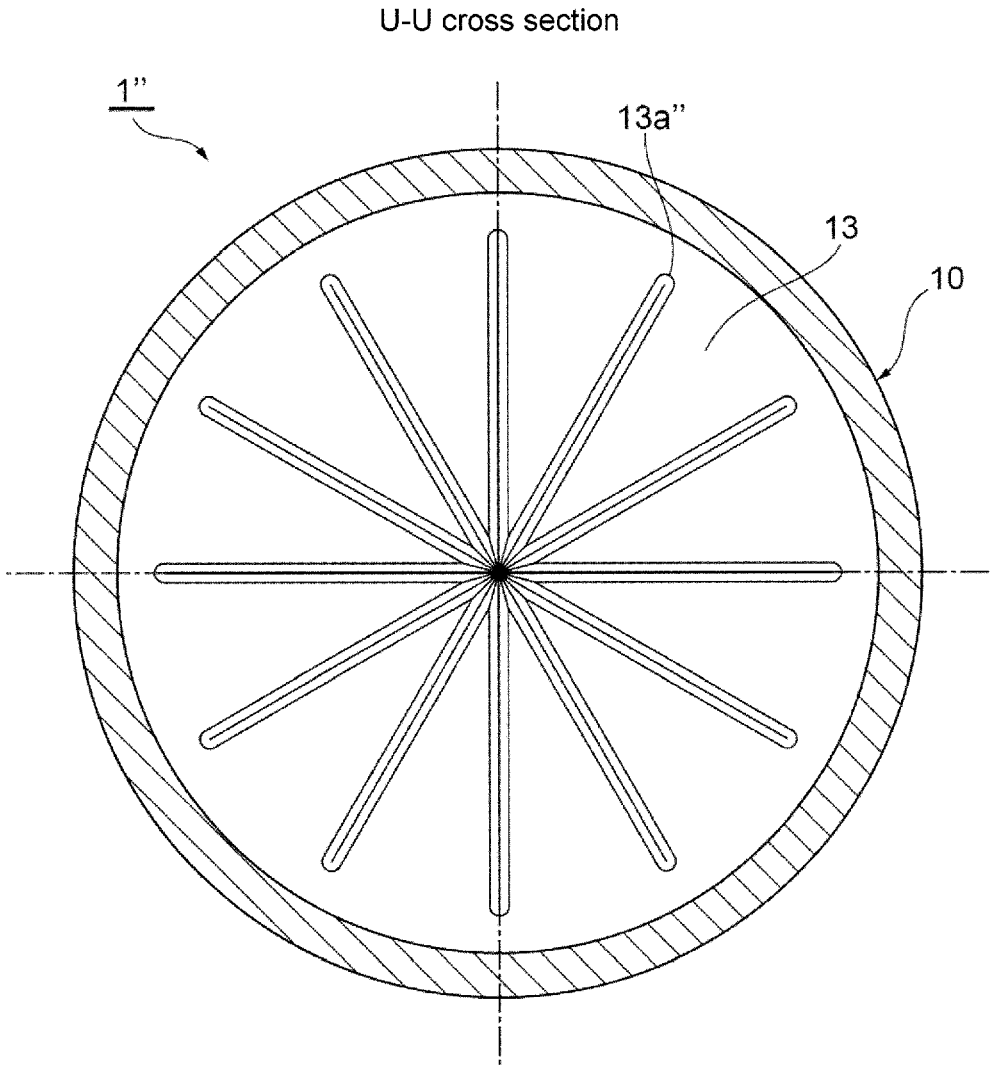
FIG. 5 is an enlarged cross-sectional view showing a tank bottom in another example of the accumulator shown in FIG. 1.

In the present embodiment as stated above, the plurality of annular protrusions 13*a* are formed concentrically at the bottom 13 of the tank 10. Instead, the protrusions may be formed spirally as shown in FIG. 4, or may be formed radially from the center of the bottom 13 of the tank 10 as shown in FIG. 5, for example.

In the present embodiment as stated above, the knurling part 37 is provided at a height area between the lower-limit liquid surface height position Hmin and the highest liquid surface height position Hmax of the outer pipe 32. Instead, such a knurling part may be provided vertically (along the axial line) over the entire of the outer pipe 32.

Embodiment 2

Figure 6:
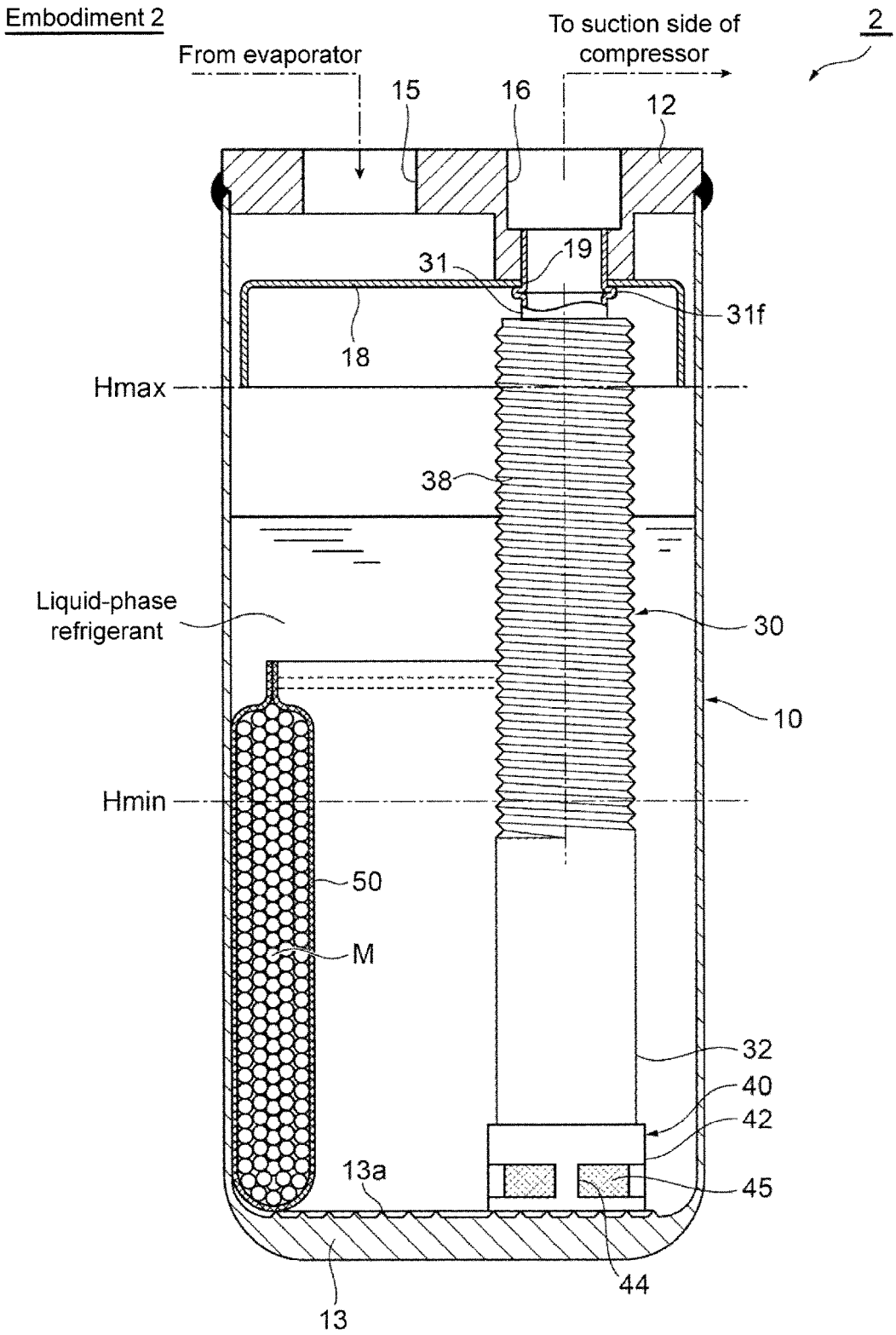
FIG. 6 is a partially cutaway front view showing Embodiment 2 of an accumulator according to the present invention.

FIG. 6 is a partially cutaway front view showing Embodiment 2 of an accumulator according to the present invention.

The accumulator 2 of Embodiment 2 in the drawing is different from the accumulator 1 of Embodiment 1 only in how to form the protrusions on the outer pipe 32, and the configuration in the other respects is the same. In FIG. 6 showing the accumulator 2 of Embodiment 2, the same reference numerals are assigned to the parts corresponding to those of the accumulator 1 of Embodiment 1. That is, although the protrusions serving as an origination of boiling are formed by knurling in the accumulator 1 of Embodiment 1, the protrusions of the accumulator 2 of Embodiment 2 are formed by threading.

Specifically the outer pipe 32 of the accumulator 2 of Embodiment 2 is provided with a threading part 38 from a slightly below the lower-limit liquid surface height position Hmin to the upper end of the outer pipe 32, in which spiral protrusions (threads) are formed on the outer periphery of the outer pipe (by threading).

In the thus configured accumulator 2 of Embodiment 2 as well, the protrusions (including the protrusions at the threading part 38 on the outer pipe 32 and the protrusions 13*a* on the upper face of the bottom 13 of the tank 10) serving as an origination of boiling (generation of air bubbles) are provided at a part soaked with a liquid part (liquid-phase refrigerant and oil) accumulated in the tank 10 of the accumulator 2, and the protrusions on the outer pipe 32 can be formed by threading. Therefore the accumulator can have substantially the same functions and advantageous effects as those of the accumulator 1 of Embodiment 1, and has another effect of reducing the cost for the machining of the protrusions.

Embodiment 3

Figure 7:
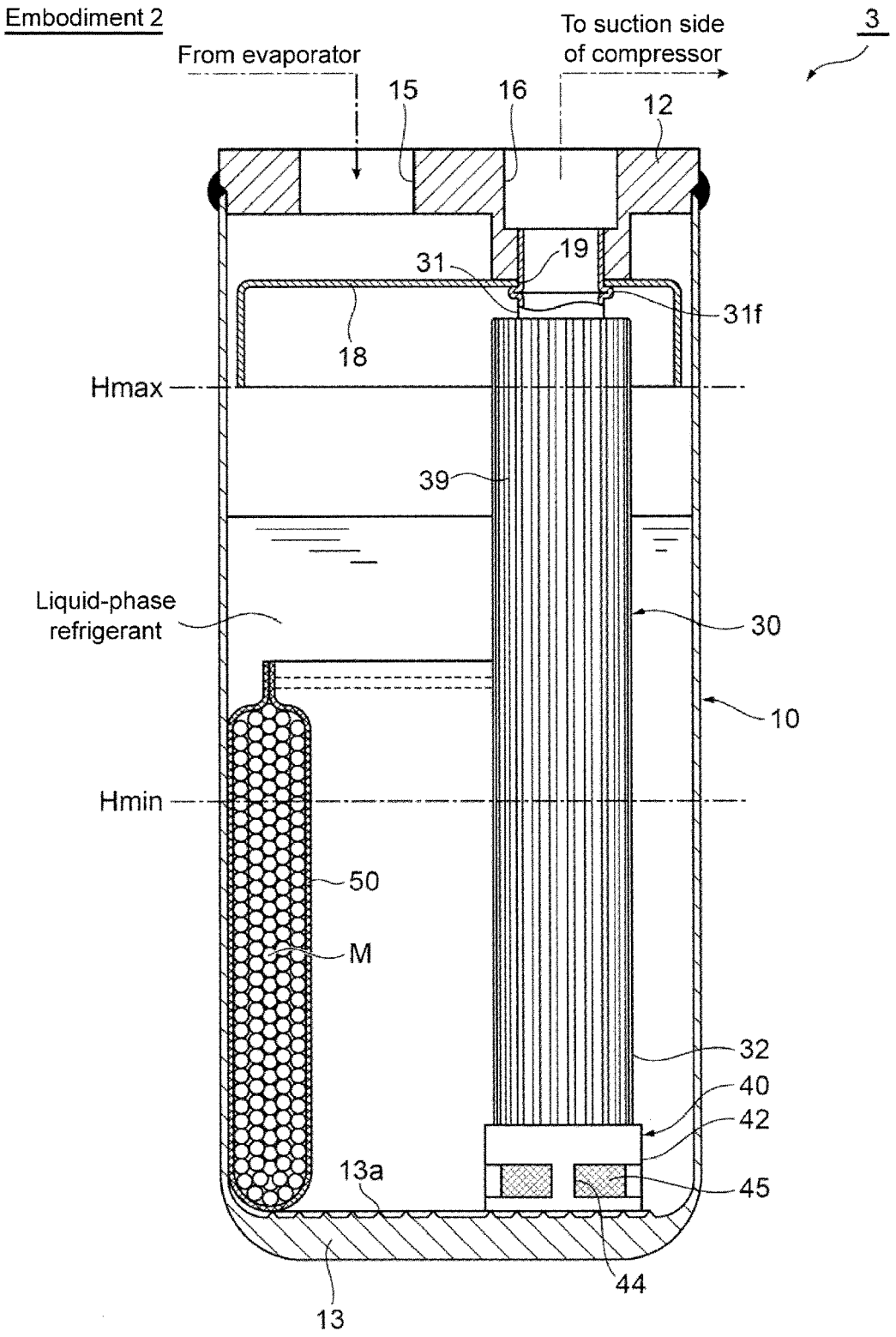
FIG. 7 is a partially cutaway front view showing Embodiment 3 of an accumulator according to the present invention.

FIG. 7 is a partially cutaway front view showing Embodiment 3 of an accumulator according to the present invention.

The accumulator 3 of Embodiment 3 in the drawing is different from the accumulator 1 of Embodiment 1 only in how to form the protrusions on the outer pipe 32, and the configuration in the other respects is the same. In FIG. 7 showing the accumulator 3 of Embodiment 3, the same reference numerals are assigned to the parts corresponding to those of the accumulator 1 of Embodiment 1. That is, although the protrusions serving as an origination of boiling are formed by knurling in the accumulator 1 of Embodiment 1, the protrusions of the accumulator 3 of Embodiment 3 are formed concurrently with the extrusion forming of the outer pipe 32.

Specifically the outer pipe 32 of the accumulator 3 of Embodiment 3 is provided with a grooving part 39 on the outer periphery from the lower end to the upper end of the outer pipe 32 (along the vertical direction), in which a plurality of protrusions elongated along the vertical direction (along the axial line of the outer pipe 32) are formed (by extrusion forming).

In the thus configured accumulator 3 of Embodiment 3 as well, the protrusions (including the protrusions at the grooving part 39 on the outer pipe 32 and the protrusions 13*a* on the upper face of the bottom 13 of the tank 10) serving as an origination of boiling (generation of air bubbles) are provided at a part soaked with a liquid part (liquid-phase refrigerant and oil) accumulated in the tank 10 of the accumulator 3, and the protrusions on the outer pipe 32 can be formed concurrently with the extrusion forming of the outer pipe 32. Therefore the accumulator can have substantially the same functions and advantageous effects as those of the accumulator 1 of Embodiment 1, and has another effect of reducing the cost for the machining and the number of machining steps of the protrusions.

Although not illustrated, the protrusions may be formed on the inner periphery of the tank 10 instead of the outer periphery or as well as on the outer periphery of the outer pipe 32. Obviously in that case also, a plurality of protrusions, spiral protrusions, protrusions vertically elongated and the like can be formed on the inner periphery of the tank 10 by the methods similar to those described in the above Embodiments 1 to 3.

Although the above Embodiments 1 to 3 include the outflow pipe having a double-pipe structure including an inner pipe and an outer pipe, the present invention is obviously applicable to another type of accumulator as well, including an outflow pipe of a U-letter shape, for example, having one end that is joined to the outflow port and the opening on the other-end side that is located close to the lower face of the gas-liquid separating member.

Embodiment 4

Figure 8:
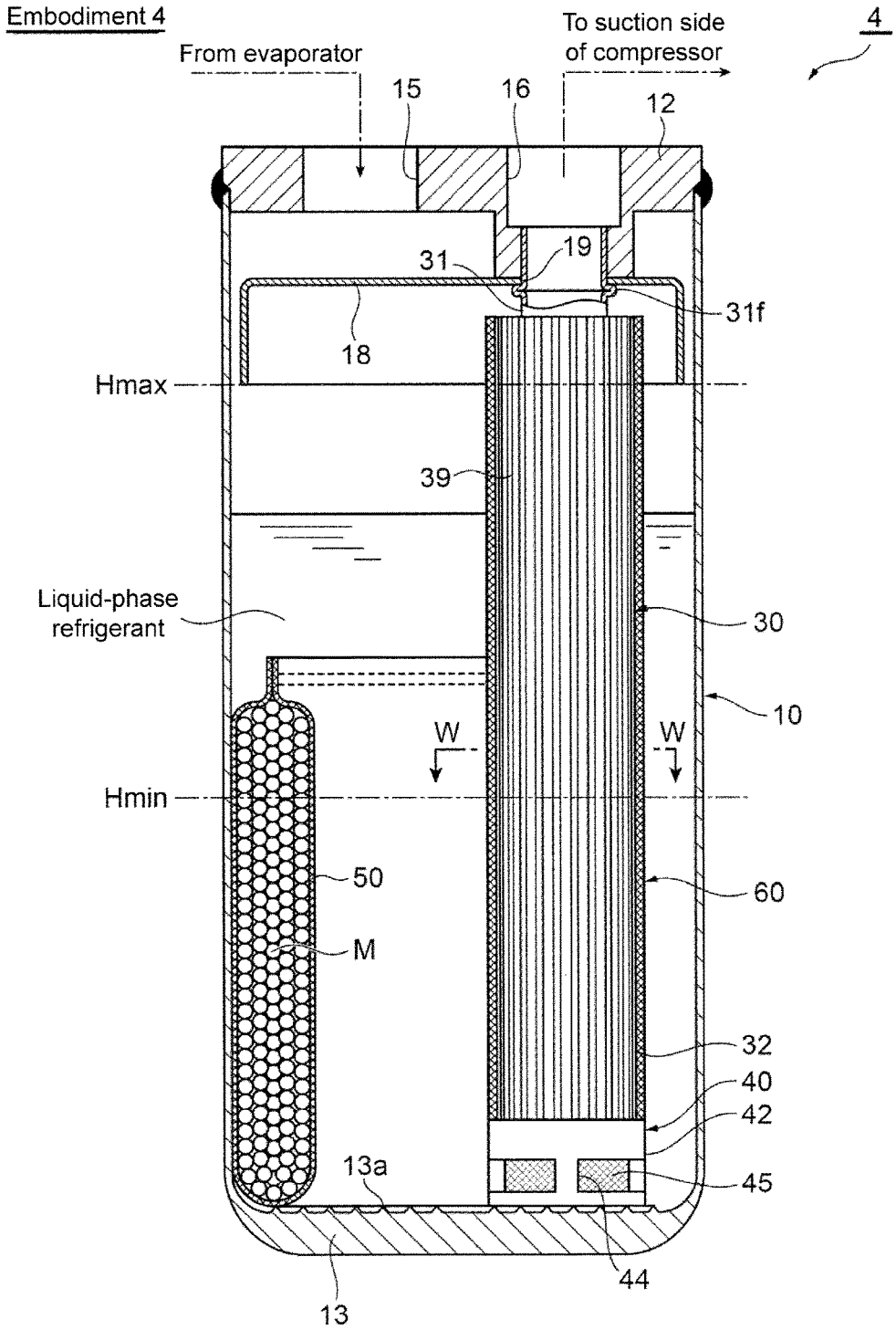
FIG. 8 is a partially cutaway front view showing Embodiment 4 of an accumulator according to the present invention.
Figure 9:
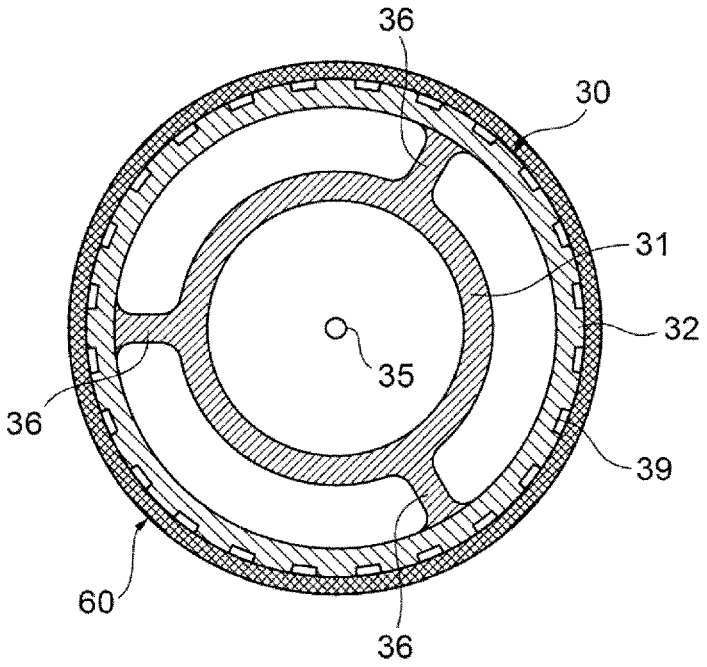
FIG. 9 is an enlarged cross-sectional view taken along the arrow W-W of FIG. 8.

FIG. 8 is a partially cutaway front view showing Embodiment 4 of an accumulator according to the present invention, and FIG. 9 is an enlarged cross-sectional view taken along the arrow W-W of FIG. 8.

The accumulator 4 of Embodiment 4 in the drawing is different from the accumulator 3 of Embodiment 3 only in that a cloth-like member or the like is wound around or externally inserted to the outer pipe 32, and the configuration in the other respects is the same. In FIGS. 8 and 9 showing the accumulator 4 of Embodiment 4, the same reference numerals are assigned to the parts corresponding to those of the accumulator 3 of Embodiment 3.

Specifically the accumulator 4 of Embodiment 4 is configured so that a cloth-like member 60, such as felt or a mesh-form plate member having flexibility or elasticity, is wound around and externally inserted so as to cover the entire area of a part above the strainer 40 of the outer periphery (of the grooving part 39) of the outer pipe 32. Instead of the cloth-like member 60, a foam material may be used, and examples of the foam material include a member made of commercially available synthetic resin, rubber, ceramics or the like.

In this configuration as in FIG. 9 showing the cross section, three rib plates 36 are disposed along the longitudinal direction (vertical direction) so as to protrude radially inwardly at equal angular intervals to the outside of the inner pipe 31, and the outer pipe 32 is externally inserted for fixing to the outer periphery of these three rib plates 36 in a slightly press-fitting manner. Note here that the inner pipe 31, the outer pipe 32 and the rib plates 36 may be integrally formed by extrusion forming using a synthetic resin material, an aluminum material or the like as stated above. That is, the aforementioned double-pipe structure may be an integrally-formed product made of an aluminum extruded material, for example.

The thus configured accumulator 4 of the present embodiment has substantially the same functions and advantageous effects as those of the accumulators 1 to 3 of Embodiments 1 to 3. Additionally, since the refrigerant coming into contact with the grooves (or protrusions) provided on the outer pipe 32 is in a loose state because of the cloth-like member 60 wound around or externally inserted to the outer pipe 32 of the outflow pipe 30, so that the pressure thereof drops, the grooves (or protrusions) on the outer pipe 32 can be an origination (trigger) for boiling of the liquid-phase refrigerant for vaporization during starting of the compressor 210, which leads to the state where air bubbles come out gradually, i.e., the liquid-phase refrigerant is gradually vaporized. Therefore boiling of the liquid-phase refrigerant proceeds gently and as a result a bumping phenomenon in which the liquid-phase refrigerant boils at once and explosively, and impact noise generated accordingly can be more effectively suppressed.

In this case, the accumulator 4 of the present embodiment includes a simple configuration added, like the cloth-like member 60 that is wound around or externally inserted to the outer pipe 32, and therefore this has excellent cost-effectiveness without making the structure of the accumulator complicated or increasing the cost and the size thereof as in the conventional techniques as stated above.

In the above embodiment, the cloth-like member 60 is provided so as to cover the entire area of a part above the strainer 40 of the outer periphery of the outer pipe 32. In this respect, in order to suppress a bumping phenomenon and the following impact noise during the starting of the compressor 210, the cloth-like member 60 may be basically wound around or externally inserted to a height area between the lower-limit liquid surface height position Hmin where abnormal sound (impact noise) is generated because of bumping of the liquid part (liquid-phase refrigerant and oil) accumulated in the tank 10 during stopping of the compressor 210 and the highest liquid surface height position Hmax of the liquid part.

Embodiment 5

Figure 10:
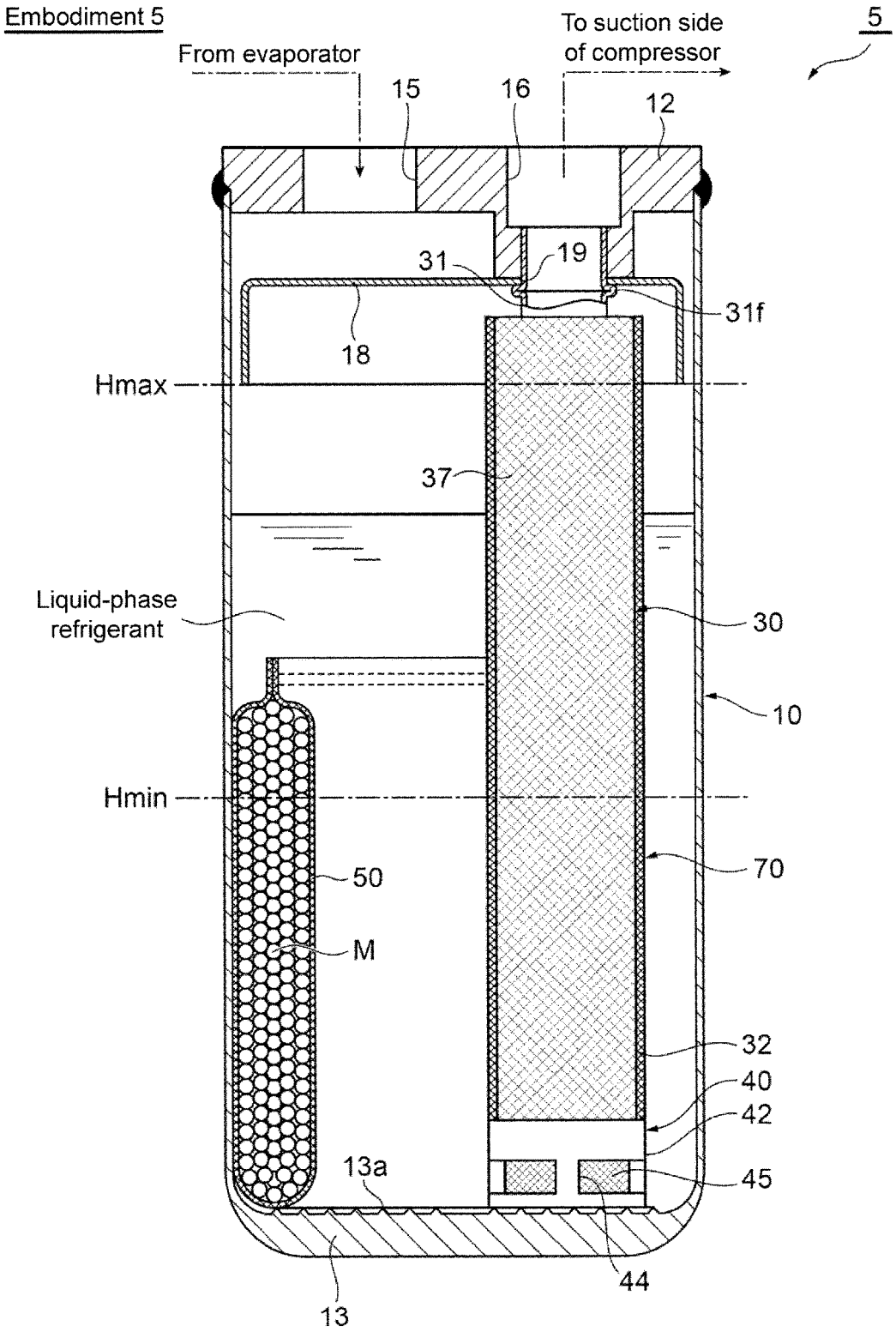
FIG. 10 is a partially cutaway front view showing Embodiment 5 of an accumulator according to the present invention.

FIG. 10 is a partially cutaway front view showing Embodiment 5 of an accumulator according to the present invention.

The accumulator 5 of Embodiment 5 in the drawing is different from the accumulator 1 of Embodiment 1 only in that a cloth-like member or the like is wound around or externally inserted to the outer pipe 32, and the configuration in the other respects is the same. In FIG. 10 showing the accumulator 5 of Embodiment 5, the same reference numerals are assigned to the parts corresponding to those of the accumulator 1 of Embodiment 1.

Specifically the accumulator 5 of Embodiment 5 is configured so that, similarly to the accumulator 4 of Embodiment 4 as stated above, a cloth-like member 70 such as felt is wound around and externally inserted so as to cover the entire area of a part above the strainer 40 of the outer periphery (of the knurling part 37) of the outer pipe 32.

In this embodiment, the knurling part 37 is provided from the lower end to the upper end (over the vertically entire) of the outer pipe 32.

The thus configured accumulator 5 of Embodiment 5 also can have substantially the same functions and advantageous effects as those of the accumulators 1 to 3 of Embodiments 1 and 3, and has another effect that is substantially similar to that from the accumulator 4 of Embodiment 4.

Embodiment 6

Figure 11:
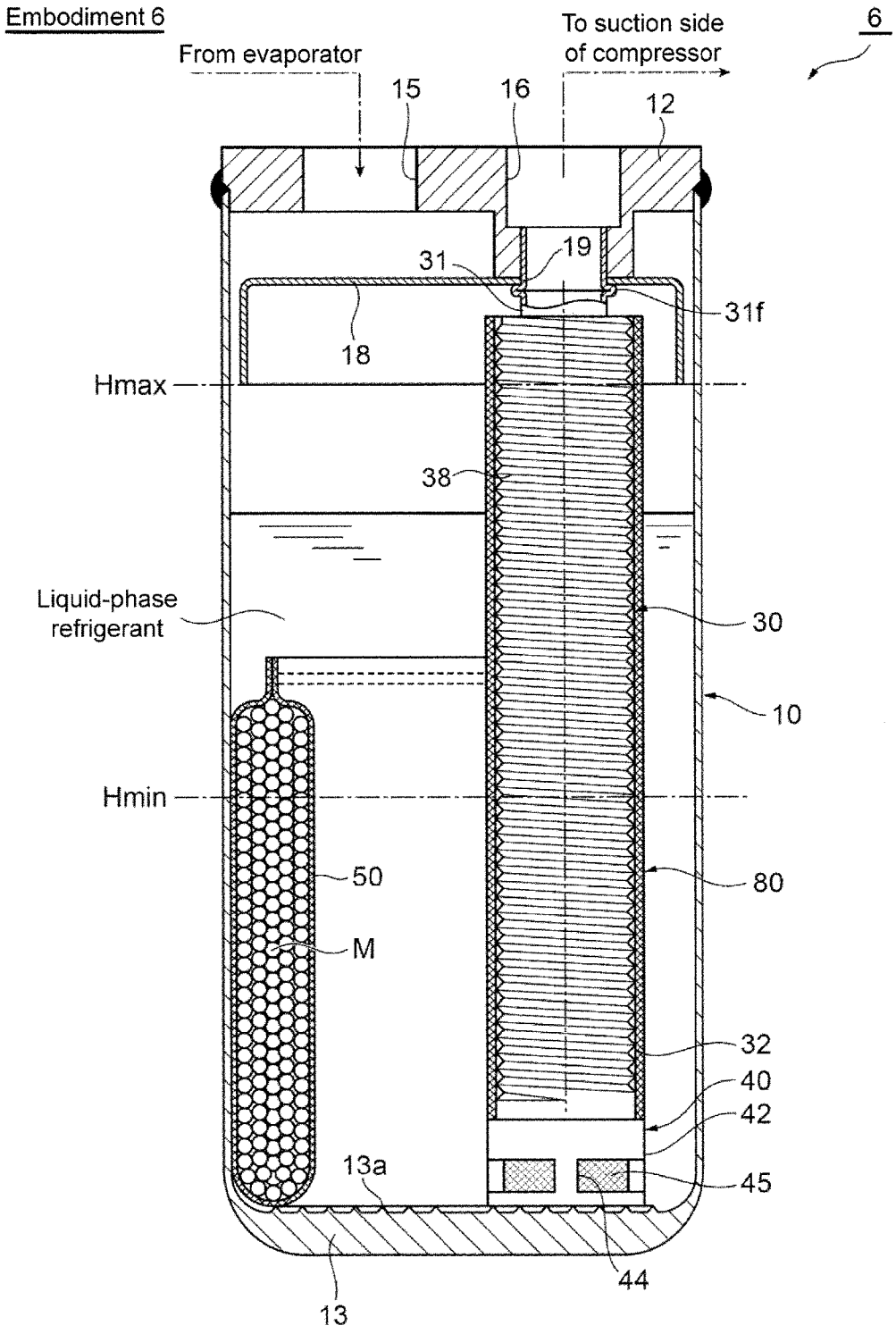
FIG. 11 is a partially cutaway front view showing Embodiment 6 of an accumulator according to the present invention.

FIG. 11 is a partially cutaway front view showing Embodiment 6 of an accumulator according to the present invention.

The accumulator 6 of Embodiment 6 in the drawing is different from the accumulator 2 of Embodiment 2 only in that a cloth-like member or the like is wound around or externally inserted to the outer pipe 32, and the configuration in the other respects is the same. In FIG. 11 showing the accumulator 6 of Embodiment 6, the same reference numerals are assigned to the parts corresponding to those of the accumulator 2 of Embodiment 2.

Specifically the accumulator 6 of Embodiment 6 is configured so that, similarly to the accumulators 4, 5 of Embodiments 4, 5 as stated above, a cloth-like member 80 such as felt is wound around and externally inserted so as to cover the entire area of a part above the strainer 40 of the outer periphery (of the threading part 38) of the outer pipe 32.

In this embodiment, the threading part 38 is provided from a part slightly above the strainer 40 of the outer pipe 32 to the upper end thereof.

The thus configured accumulator 6 of Embodiment 6 also can have substantially the same functions and advantageous effects as those of the accumulators 1 to 3 of Embodiments 1 to 3, and has another effect that is substantially similar to that from the accumulators 4, 5 of Embodiments 4, 5.

Embodiment 7

Figure 12:
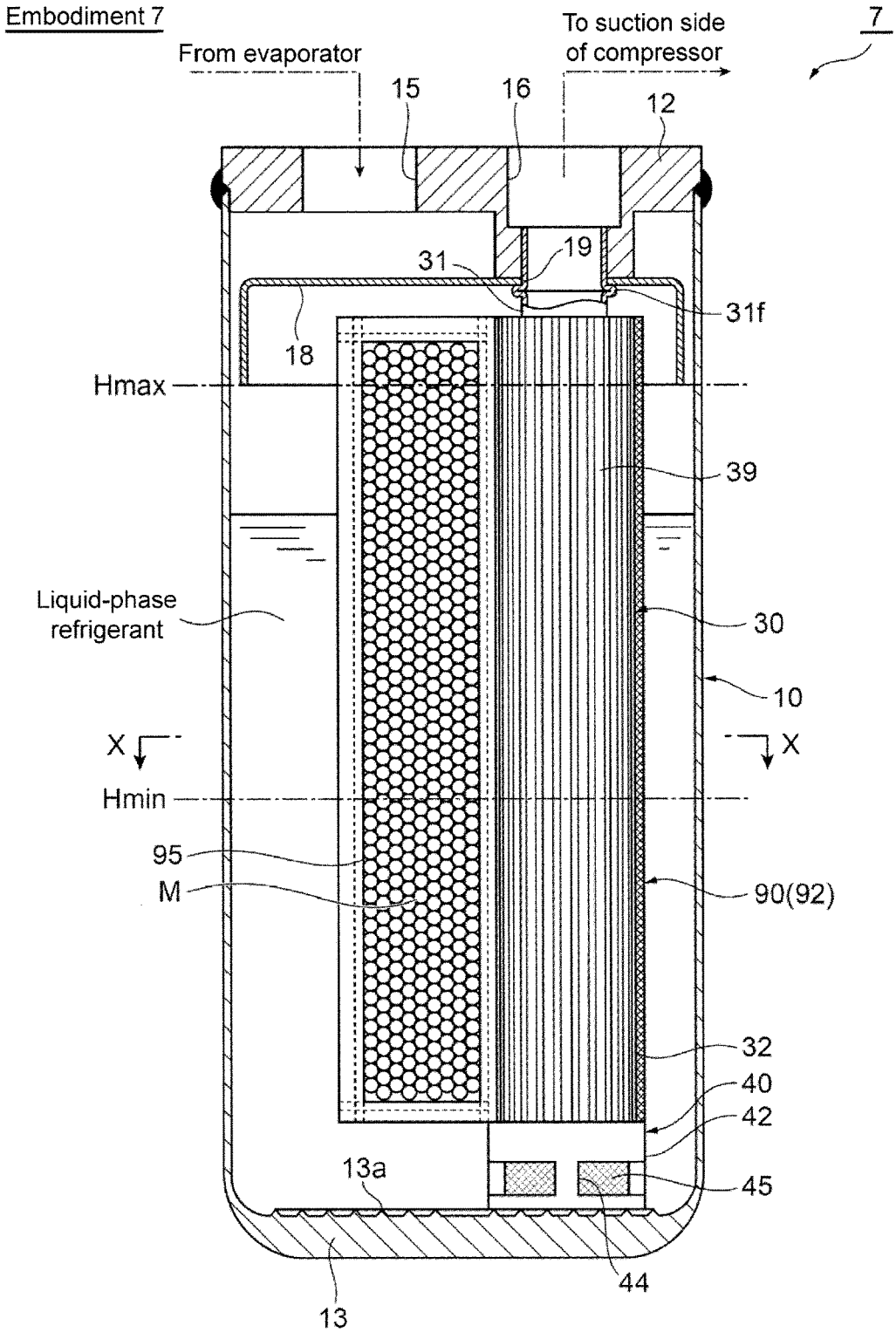
FIG. 12 is a partially cutaway front view showing Embodiment 7 of an accumulator according to the present invention.
Figure 13:
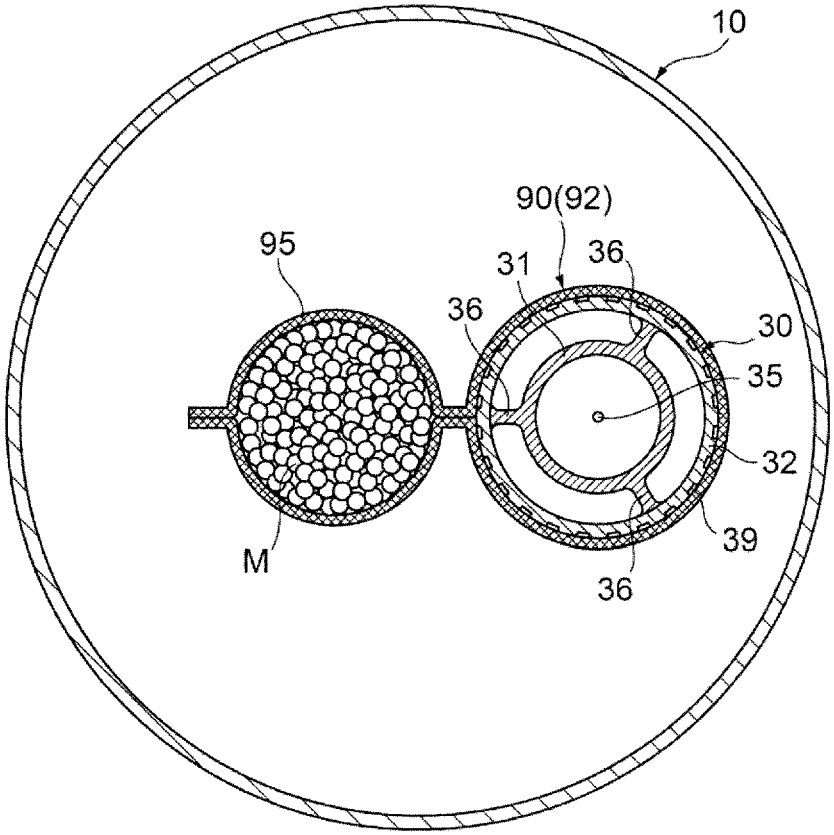
FIG. 13 is a cross-sectional view taken along the arrow X-X of FIG. 12.

FIG. 12 is a partially cutaway front view showing Embodiment 7 of an accumulator according to the present invention, and FIG. 13 is a cross-sectional view taken along the arrow X-X of FIG. 12.

The accumulator 7 of Embodiment 7 in the drawing is different from the accumulator 4 of Embodiment 4 only in that the bag 50 containing desiccant M is removed, a cloth-like member 90, such as felt, is provided with an externally-inserted part 92 that is externally inserted for fixing to the outer periphery (of the grooving part 39) of the outer pipe 32, and a cylindrical desiccant storage part 95 is provided, whose top and bottom are blocked to store desiccant M to absorb and remove water in the refrigerant, and the configuration in the other respects is the same. In FIGS. 12 and 13 showing the accumulator 7 of Embodiment 7, the same reference numerals are assigned to the parts corresponding to those of the accumulator 4 of Embodiment 4.

The desiccant storage part 95 is disposed vertically (along the axial line of the outer pipe 32) and externally to the outer pipe 32 at a position closer to the inflow port 15. In this embodiment, the desiccant storage part 95 is provided from the upper end to the lower end of the externally-inserted part 92, where the lower end thereof is located below the lower-limit liquid surface height position Hmin where abnormal sound (impact noise) is generated because of bumping of the liquid part (liquid-phase refrigerant and oil) accumulated in the tank 10 during stopping of the compressor 210, the upper end thereof is located above the highest liquid surface height position Hmax of the liquid part (liquid-phase refrigerant and oil) accumulated in the tank 10 during stopping of the compressor 210, and the upper part thereof protrudes above from the highest liquid surface height position Hmax.

Since the cloth-like member such as felt has air permeability and water permeability, the desiccant storage part 95 to store desiccant M therein to absorb and remove water in the refrigerant is disposed at the cloth-like member 90, such as felt, in addition to the externally-inserted part 92, whereby the desiccant storage part 95 serves as a bag. Therefore there is no need to prepare a bag to store desiccant M or its fixing means (e.g., banding band) separately, and so the cost-effectiveness can be improved more.

Further, the upper part of the desiccant storage part 95 is located above the highest liquid surface height position Hmax, and this configuration can suppress a bumping phenomenon and the following impact noise during starting of the compressor 210 more reliably.

In the illustrated example, the desiccant storage part is provided at the cloth-like member of the accumulator 4 of Embodiment 4, and obviously such a desiccant storage part may be provided at the cloth-like member of the accumulator 5 of Embodiment 5 or of the accumulator 6 of Embodiment 6.

Modified Embodiments of Embodiments 4 to 7

Figure 14:
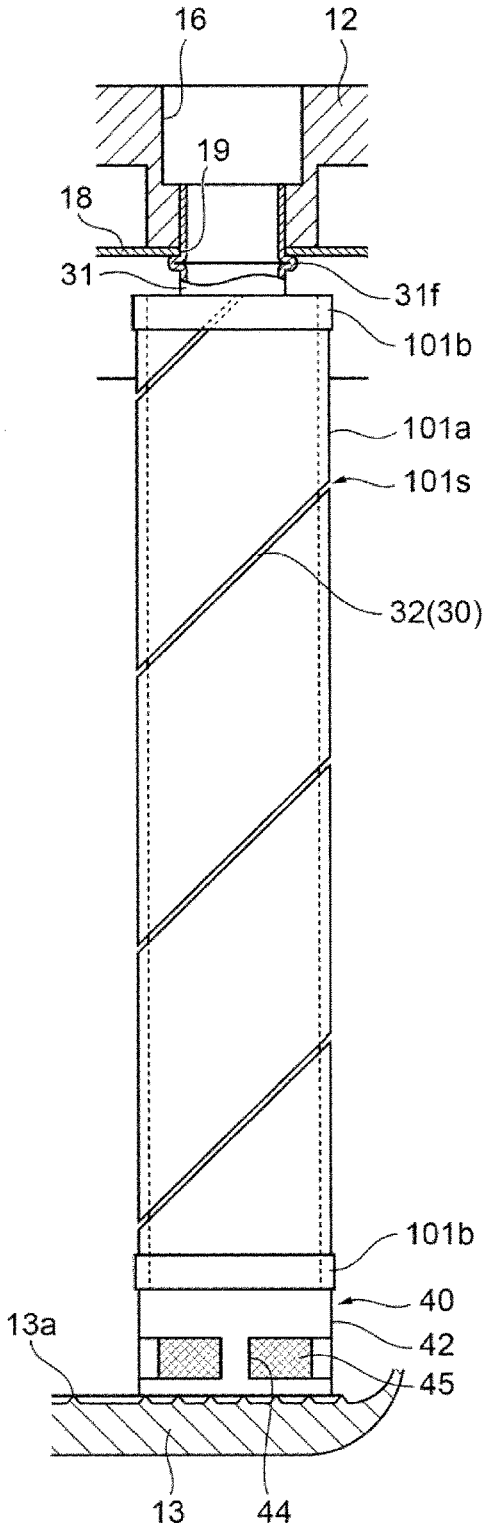
FIG. 14 is a partially cutaway front view showing a major part of a modified (first) embodiment of Embodiments 4 to 7.

For the cloth-like member or the like in Embodiments 4 to 7 as stated above, a piece of (rectangular) material is used, which may be wound around or externally fitted to the outer pipe. Alternatively as shown in FIG. 14, a piece of long and thin material (e.g., a cloth-like member such as felt or a mesh-form plate member having flexibility or elasticity, or a material made of a foam material including synthetic resin, rubber, ceramics or the like) 101*a* may be used, which may be wound around or externally inserted to the outer pipe 32 spirally, and the upper end and the lower end thereof may be fixed by fixing means (e.g., banding band) 101*b*. In this case, the long and thin material 101*a* may be wound around or externally inserted to the outer pipe 32 so that there is a slight (vertical) gap 101*s* between their (upper and lower) end faces as in the drawing, or may be wound around or externally inserted to the outer pipe 32 so that their (upper and lower) end faces may abut (i.e., without gaps) or may be overlapped. In such configurations, the (upper and lower) end faces of the long and thin material 101*a* serve as a trigger of refrigerant boiling more effectively.

Figure 15:
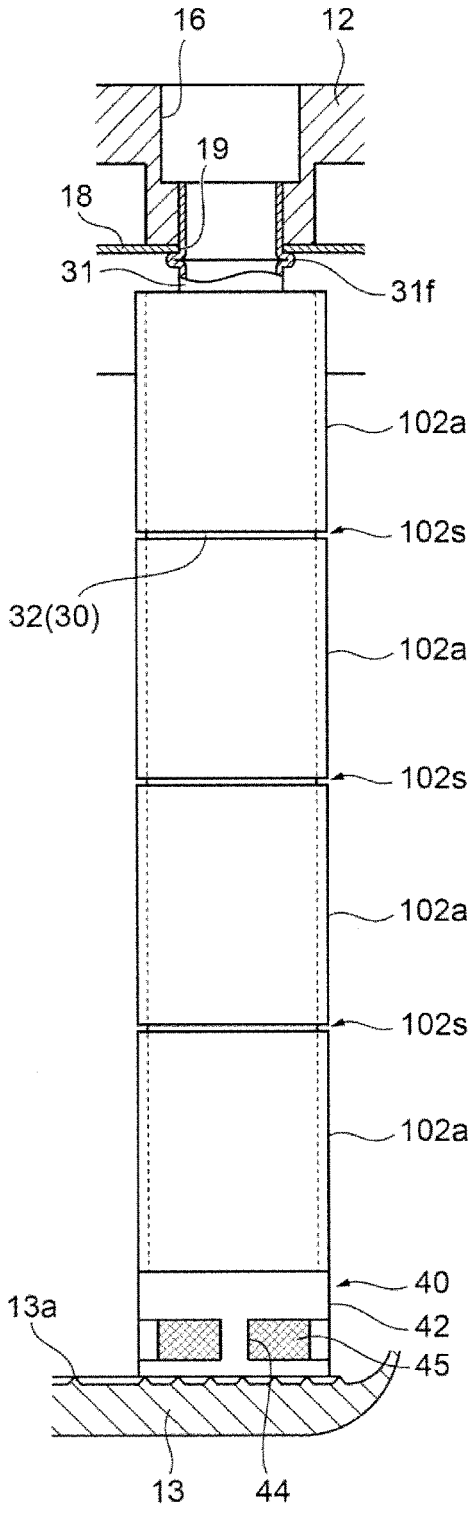
FIG. 15 is a partially cutaway front view showing a major part of a modified (second) embodiment of Embodiments 4 to 7.
Figure 16:
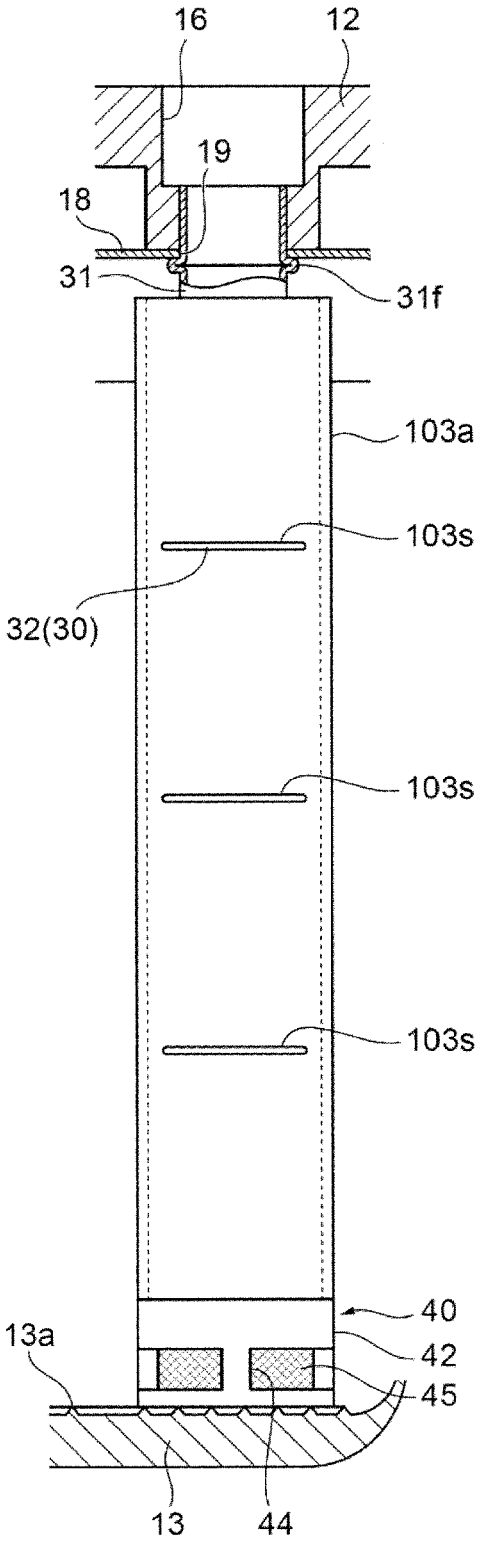
FIG. 16 is a partially cutaway front view showing a major part of a modified (third) embodiment of Embodiments 4 to 7.
Figure 17:
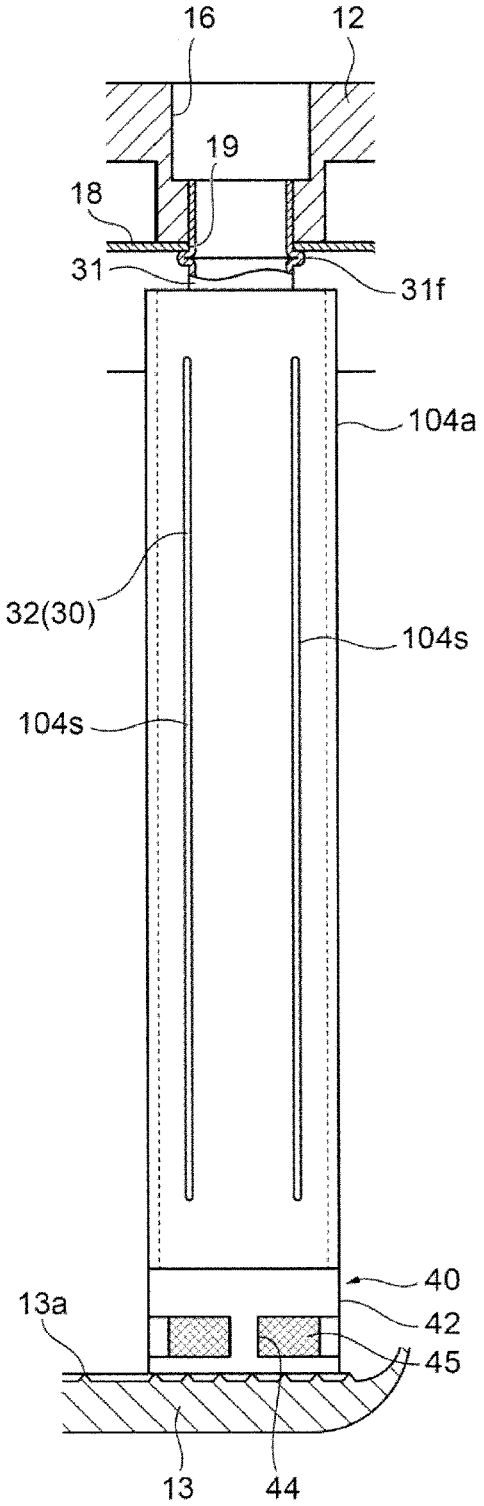
FIG. 17 is a partially cutaway front view showing a major part of a modified (fourth) embodiment of Embodiments 4 to 7.
Figure 18:
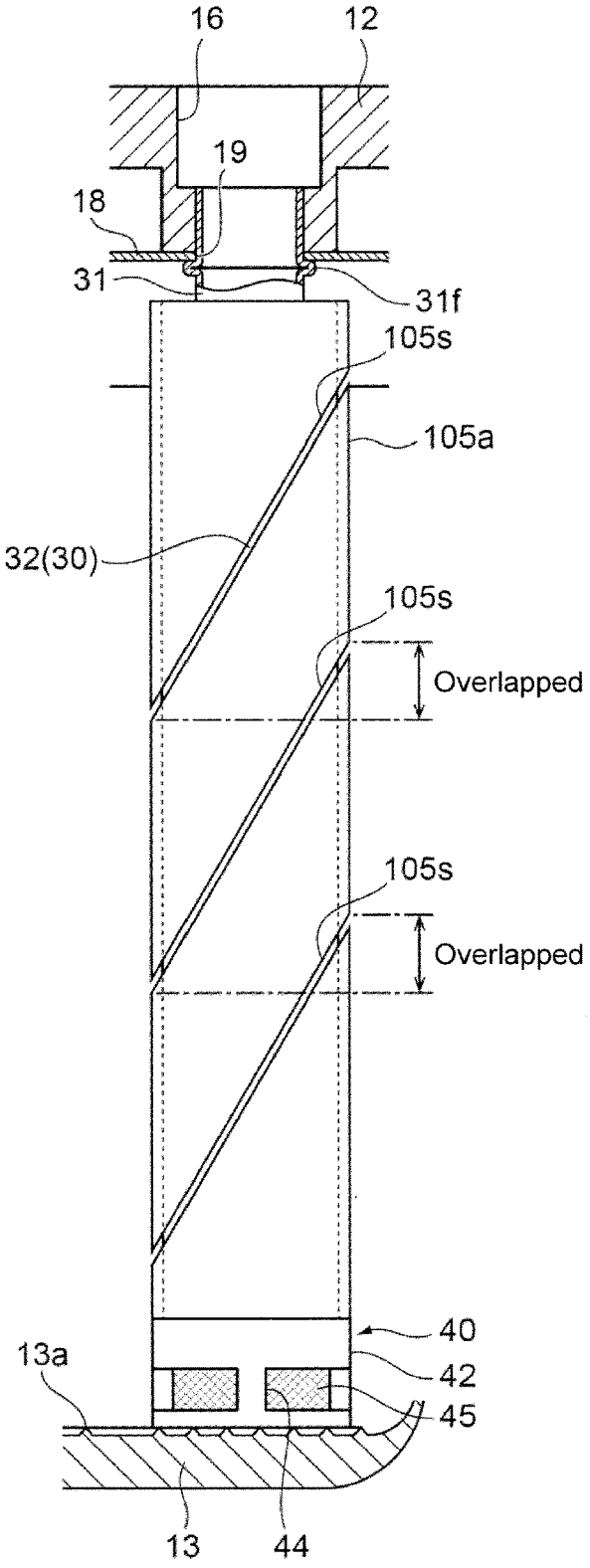
FIG. 18 is a partially cutaway front view showing a major part of a modified (fifth) embodiment of Embodiments 4 to 7.
Figure 19:
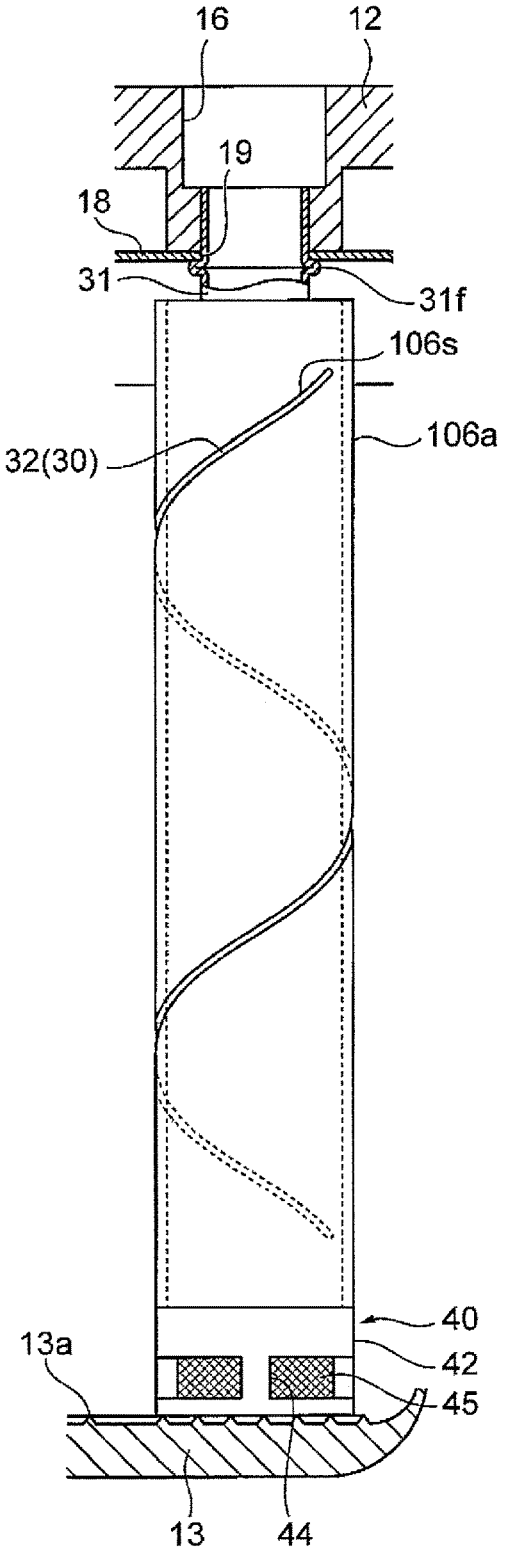
FIG. 19 is a partially cutaway front view showing a major part of a modified (sixth) embodiment of Embodiments 4 to 7.

Alternatively as shown in FIG. 15, for example, a plurality of pieces (four in the illustrated example) of a material 102*a* may be used, which may be wound around or externally fitted to the outer pipe 32 so as to be close to each other. In this case, the plurality of pieces of the material 102*a* may be wound around or externally inserted to the outer pipe 32 so that there is a slight (vertical) gap 102*s* between their (upper and lower) end faces as in the drawing, or may be wound around or externally inserted to the outer pipe 32 so that their (upper and lower) end faces may abut (i.e., without gaps) or may be overlapped. Also in such configurations, their (upper and lower) end faces serve as a trigger of refrigerant boiling more effectively.

In any case of including one piece of material or a plurality of pieces of material, the material may have a slit (cut line) as shown in FIGS. 16 to 19, for example). FIGS. 16 to 19 show the form including one piece of material (103*a* to 106*a*), in which slits (cut lines) (103*s* to 106*s*) are formed. In this case, the slits may be a horizontal slit 103*s* formed horizontally (the form shown in FIG. 16), a vertical slit 104*s* formed vertically (the form shown in FIG. 17), a diagonal slit 105*s* formed diagonally to the vertical direction (or horizontal direction) in a lateral view (the form shown in FIG. 18), or a spiral slit 106*s* formed spirally (the form shown in FIG. 19). In such a configuration, these various types of slits serve as a trigger of refrigerant boiling more effectively. Especially when these slits are the diagonal slit 105*s* (as in the illustrated example, the diagonal slits formed in a vertically overlapped manner) or the spiral slits 106*s*, the slits can be made longer, meaning that the area serving as a trigger of refrigerant boiling can increase more effectively.

As stated above, in order to suppress a bumping phenomenon and the following impact noise during the starting of the compressor 210, the (upper and lower) end faces of the long and thin material 101*a* shown in FIG. 14, the (upper and lower) end faces of a plurality of pieces of material 102*a* shown in FIG. 15, the slits (cut lines) shown in FIGS. 16 to 19 (103*s* to 106*s*) may be basically set at a height area between the lower-limit liquid surface height position Hmin where abnormal sound (impact noise) is generated because of bumping of the liquid part (liquid-phase refrigerant and oil) accumulated in the tank during stopping of the compressor 210 and the highest liquid surface height position Hmax of the liquid part.

What is claimed is:

1. An accumulator comprising:

a tank having an inflow port and an outflow port therein, the tank having a depth in an axial direction and being configured to store a liquid inside including liquid phase refrigerant and oil accumulated in the tank;

an outflow pipe arranged in the tank in alignment with the outflow port; and lines of first protrusions formed to run spirally or straight in the axial direction around an outer peripheral surface of the outflow pipe within an axial range extensive along the outflow pipe within which a phase surface separating the liquid-phase refrigerant and the oil accumulated in the tank of the accumulator is located.

2. The accumulator according to claim 1, further comprising: an inner pipe joined to the outflow port and hanging inside of the outflow pipe; and at least one of (i) a plurality of second protrusions formed to run in an inner periphery of the tank or (ii) a plurality of third protrusions formed in an upper face of a bottom of the tank.

3. The accumulator according to claim 2, wherein the lines of first protrusions are formed in the outer periphery of the outflow pipe between the axial range a bottom of which is located above the bottom of the tank by a first predetermined height and a top of which is located below from an upper end of the outflow pipe by a second predetermined height.

4. The accumulator according to claim 2, wherein the plurality of second protrusions are formed to run spirally or straight along the axial direction around the inner periphery of the tank.

5. The accumulator according to claim 2, wherein the plurality of third protrusions are formed in a concentric or spiral shape and extensive in the upper face of the bottom of the tank.

6. The accumulator according to claim 2, wherein the plurality of second protrusions are formed concurrently with formation of the outflow pipe and the plurality of third protrusions are formed concurrently with formation of the tank.

7. The accumulator according to claim 1, wherein the lines of first protrusions are formed in a pressing or cutting configuration.

8. The accumulator according to claim 1, wherein the lines of first protrusions are formed in a knurling or threading configuration.

9. An accumulator comprising:

a tank having an inflow port and an outflow port therein, the tank having a depth in an axial direction and being configured to store a liquid inside including liquid phase refrigerant and oil accumulated in the tank;

an outflow pipe arranged in the tank in alignment with the outflow port;

lines of protrusions formed to run spirally or straight in the axial direction around an outer peripheral surface of the outflow pipe within an axial range extensive along the outflow pipe between which a phase surface separating the liquid-phase refrigerant and the oil accumulated in the tank of the accumulator is located;

an inner pipe joined to the outflow port and hanging inside of the outflow pipe; and at least one of (i) a plurality of second protrusions formed to run in an inner periphery of the tank or (ii) a plurality of third protrusions formed in an upper face of a bottom of the tank; and a cloth-like member or a foam material wound externally around the outflow pipe.

10. The accumulator according to claim 9, wherein the cloth-like member or the foam material is wound around the outflow pipe in the axial range of the outflow pipe including an axial interval between which the phase surface separating the liquid-phase refrigerant and the oil accumulated in the tank of the accumulator is located.

11. The accumulator according to claim 9, wherein the cloth-like member is provided with a desiccant storage part to store desiccant to absorb and remove water in refrigerant.

12. The accumulator according to claim 11, wherein the desiccant storage part is disposed vertically and externally to the outflow pipe.

13. The accumulator according to claim 11, wherein the desiccant storage part is disposed on a side of the outflow pipe closer to a first imaginary line vertically extended in the tank from the inflow port than a second imaginary line vertically extended in the tank from the outflow port.

14. The accumulator according to claim 9, wherein the cloth-like member or the foam material is comprised of a long and thin strip that is wound spirally around the outflow pipe in such a manner that two adjacent turns of the strip either have a gap between them or overlap each other.

15. The accumulator according to claim 9, wherein the cloth-like member or the foam material is comprised of a plurality of thin strips that are wound side by side around the outflow pipe in such a manner that two adjacent strips either have a gap between them or overlap each other.

16. The accumulator according to claim 9, wherein the cloth-like member or the foam material has a slit.

17. The accumulator according to claim 9, wherein at least one slit is formed in the axial direction, in a direction perpendicular to the axial direction, or in a direction oblique to the axial direction.

* * * * *